US010751966B2

(12) United States Patent
Hayashi et al.

(10) Patent No.: US 10,751,966 B2
(45) Date of Patent: Aug. 25, 2020

(54) SINGLE FACER

(71) Applicant: KABUSHIKI KAISHA ISOWA, Nagoya-shi, Aichi (JP)

(72) Inventors: Hisashi Hayashi, Kiyosu (JP); Takahiro Yamada, Kasugai (JP); Naoki Mori, Komaki (JP)

(73) Assignee: KABUSHIKI KAISHA ISOWA, Aichi (JP)

( * ) Notice: Subject to any disclaimer, the term of this patent is extended or adjusted under 35 U.S.C. 154(b) by 999 days.

(21) Appl. No.: 14/473,278

(22) Filed: Aug. 29, 2014

(65) Prior Publication Data

US 2015/0059982 A1 Mar. 5, 2015

(30) Foreign Application Priority Data

Sep. 3, 2013 (JP) ..... 2013-182625
Jul. 18, 2014 (JP) ..... 2014-148039

(51) Int. Cl.
*B31F 1/28* (2006.01)

(52) U.S. Cl.
CPC ..... *B31F 1/28* (2013.01); *B31F 1/2818* (2013.01); *B31F 1/2822* (2013.01); *B31F 1/2831* (2013.01); *B31F 1/2863* (2013.01); *B31F 1/2877* (2013.01)

(58) Field of Classification Search
CPC ..... B31F 1/2877; B31F 1/2831; B31F 1/28; B31F 1/2818; B31F 1/2863; B31F 1/2822
See application file for complete search history.

(56) References Cited

U.S. PATENT DOCUMENTS 4,319,947 A 3/1982 Tokuno
4,916,635 A * 4/1990 Singer ..... G05B 19/19 700/254
5,449,431 A * 9/1995 Isowa ..... B31F 1/2877 156/205
5,876,530 A 3/1999 Seki et al.
6,692,602 B1 2/2004 Mensing et al.

FOREIGN PATENT DOCUMENTS

DE 43 05 158 A1 8/1994
JP 58-42025 B2 9/1983
JP 4095745 B2 6/2008

OTHER PUBLICATIONS

Machine Translation DE 4305158A1 to English, retrived from the internet on Jul. 6, 2017 https://worldwide.espacenet.com/publicationDetails/description?CC=DE&NR=4305158A1&KC=A1&FT=D&ND=3&date=19940825&DB=EPODOC&locale=en_EP#.*

Extended European Search Report in corresponding European Application No. 14002996.8, dated Jan. 19, 2015, 9 pages.

* cited by examiner

*Primary Examiner* — Vishal I Patel
(74) *Attorney, Agent, or Firm* — Brinks Gilson & Lione

(57) ABSTRACT

A single facer comprises: a swingable frame supporting a press roll in such a manner as to allow a gap between one of a pair of corrugating rolls and the press roll to be changed; an adjusting screw contactable with a contact member coupled to the swingable frame; an encoder for detecting vibration of the press roll occurring during formation of a corrugated medium by the pair of corrugating rolls; and a control section for controlling drive of a motor for displacing the adjusting screw. The control section is configured to execute a first control processing of driving the motor until a magnitude of the vibration is reduced to a given value.

7 Claims, 11 Drawing Sheets

320A

| BASIS WEIGHT OF CORRUGATED MEDIUM (g／m²) \ BASIS WEIGHT OF LINERBOARD (g／m²) | 0 ～120 | 121～160 | 161～180 | 181～200 | 201～ |
|---|---|---|---|---|---|
| 0 ～ 120 | D11 | D21 | D31 | D41 | D51 |
| 121 ～ 160 | D12 | D22 | D32 | D42 | D52 |
| 161 ～ 180 | D13 | D23 | D33 | D43 | D53 |
| 181 ～ 200 | D14 | D24 | D34 | D44 | D54 |
| 201 ～ | D15 | D25 | D35 | D45 | D55 |

SINGLE FACER

RELATED APPLICATIONS

This application claims priority under 35 U.S.C. § 119 to Japanese Patent Application Nos. 2013-182625 filed on Sep. 3, 2013 and 2014-148039 filed on Jul. 18, 2014, the entire contents of which are hereby incorporated by reference.

TECHNICAL FIELD

The present invention relates to a single facer for producing a single-faced corrugated paperboard by forming a corrugated medium and gluing a linerboard onto the corrugated medium. More specifically, the present invention relates to a single facer comprising a gap adjusting mechanism for adjusting a gap between a press or glue roll and a corrugating roll.

BACKGROUND ART

Heretofore, there has been known a gap adjusting mechanism usable in a single facer to adjust a gap between a press or glue roll and a corrugating roll. For example, a gap adjusting mechanism for a single facer described in JP 58-042025 B (Patent Document 1) comprises: a pair of wedges each having a respective one of two oppositely-tapered surfaces engageable with each other; a gap adjustment shaft to which one of the wedges is fixed; and a motor for moving the gap adjustment shaft in its axial direction to change an engagement position between the oppositely-tapered surfaces of the wedges. The other wedge is fixed to a side plate of a pressure arm supporting a press roll. The press roll is rotatably supported in an eccentric hole of a circular bearing metal of the pressure arm. An air cylinder is coupled to the side plate of the pressure arm, in such a manner as to allow the other wedge to come into engagement with the one wedge, when it is activated.

The motor for moving the gap adjustment shaft in the axial direction is controlled by a comparison between a signal indicative of a thickness of a paperboard for a corrugated medium and a thickness of a paperboard for a linerboard, and a gap detection signal indicative of a gap between the press roll and a corrugating roll. According to the motor control, the gap adjustment shaft is moved in the axial direction to change the engagement position between the wedges, so that the gap between the press roll and the corrugating roll can be adjusted. In this specification, a thickness of a paperboard for a corrugated medium and a thickness of a paperboard for a linerboard will be simply described, respectively, as "a thickness of a corrugated medium" and "a thickness of a linerboard".

SUMMARY OF THE INVENTION

Technical Problem

When a medium is nipped between a pair of corrugating rolls and thus formed into a corrugated medium, a press roll is pressed against a specific one of the corrugating rolls through the corrugated medium and a linerboard, and a glue roll is pressed against the specific corrugating roll through the corrugated medium. Along with rotation of the specific corrugating roll, each of the press roll and the glue roll periodically comes into contact with one or more ridges of a fluted portion of the specific corrugating roll, so that the periodic contacts cause vibration in each of the press roll and the glue roll.

For example, as regards the press roll, due to the vibration of the press roll, a gap detection signal indicative of a gap between the press roll and the specific corrugating roll continually changes according to the vibration. In the case where the motor described in the Patent Document 1 is controlled based on such a continually-changing gap detection signal, the gap between the press roll and the specific corrugating roll fluctuates under an influence of the vibration of the press roll. Thus, in a region between the press roll and the specific corrugating roll, there arises a problem of being unable to stably apply a nip pressure appropriate to a combination of respective thicknesses of the corrugated medium and the linerboard, to the corrugated medium and the linerboard. Similarly, in a region between the glue roll and the specific corrugating roll, there arises a problem of being unable to stably apply a nip pressure appropriate to a thickness of the corrugated medium, to the corrugated medium.

It is therefore an object of the present invention to provide a single facer capable of, in a region between an processing roll and a corrugating roll, stably applying a nip pressure appropriate to a combination of respective thicknesses of a corrugated medium and a linerboard, to the corrugated medium and the linerboard, or stably applying a nip pressure appropriate to a thickness of the corrugated medium, to the corrugated medium.

Solution to Technical Problem

First Aspect of the Present Invention and Preferred Embodiments Thereof

In order to achieve the above object, according to the first aspect of the present invention, there is provided a single facer for producing a single-faced corrugated paperboard by forming a corrugated medium and gluing a linerboard onto the corrugated medium. The single facer comprises: a pair of corrugating rolls configured to form the corrugated medium; a processing roll configured to be brought into contact with a specific one of the corrugating rolls through the corrugated medium and the linerboard or through the corrugated medium so as to perform a given processing; a supporting mechanism supporting the processing roll in such a manner as to allow a gap between the specific corrugating roll and the processing roll to be changed, wherein at least a part of the supporting mechanism is configured to be movable to cause a change in the gap; a pressing actuator section configured to press the processing roll against the specific corrugating roll through the corrugated medium and the linerboard or through the corrugated medium; a restricting mechanism comprising a restriction member disposed in contactable relation to the movable part of the supporting mechanism, wherein the restricting mechanism is configured to allow the restriction member to be displaced with respect to the movable part of the supporting mechanism; a motor configured to be driven so as to displace the restriction member; and a control section for controlling the drive of the motor, wherein the control section is configured to execute a first control processing of driving the motor until a magnitude of vibration occurring in the processing roll during the formation of the corrugated medium through the corrugating rolls is reduced to a given value.

In the first aspect of the present invention, the restricting mechanism restricts a movement of the supporting mechanism by causing the restriction member to come into contact with the movable part of the supporting mechanism. The control section executes a first control processing of driving the motor until a magnitude of vibration occurring in the processing roll during the formation of the corrugated medium through the corrugating rolls is reduced to a given value. Thus, through the first control processing, the gap between the processing roll and the specific corrugating roll is set to a reference value free from influence of the vibration of the processing roll, so that it becomes possible to apply a stable nip pressure free from influence of the vibration of the processing roll, to the corrugated medium and the linerboard or to the corrugated medium.

In the present invention, the processing roll may be any type of roll, as long as it is capable of being brought into contact with the specific corrugating roll. Examples of the processing roll include a glue roll configured to be brought into contact with the specific corrugating roll through the corrugated medium, and a press roll configured to be brought into contact with the specific corrugating roll through the corrugated medium and the linerboard.

In the present invention, the supporting mechanism may have any configuration, as long as the configuration is capable of supporting the processing roll in such a manner as to allow the gap between the specific corrugating roll and the processing roll to be changed. For example, the supporting mechanism may be composed of one mechanism integrally formed to support both opposite ends of a rotary shaft of the processing roll, or may be composed of two independent mechanisms each configured to support a respective one of the opposite ends of the rotary shaft of the processing roll. Further, the movable part of the supporting mechanism may be a swingingly-movable part, or may be a linearly-movable part.

In the present invention, the restricting mechanism may have any configuration, as long as the configuration is capable of allowing the restriction member to be displaced with respect to the movable part of the supporting mechanism. For example, the restricting mechanism may have a configuration comprising a rotationally-movable eccentric ring, or may have a configuration comprising a pair of relatively-slidingly-movable inclined surfaces, or may have a combination of these configurations.

In the present invention, as a technique of recognizing that the magnitude of the vibration occurring in the processing roll during the formation of the corrugated medium through the corrugating rolls is reduced to the given value, it is conceivable to employ a technique of determining that a magnitude of vibration detected by the detection device is reduced to a given value. Alternatively, as the technique of recognizing that the magnitude of the vibration occurring in the processing roll is reduced to the given value, it is also conceivable to employ a technique of preliminarily and experimentally measuring a time period during which the motor is driven to displace the restriction member located at a given position spaced apart from the movable part of the supporting mechanism, toward the movable part, until the magnitude of the vibration occurring in the processing roll is reduced to the given value, and determining that an actual motor drive time period becomes the pre-measured time period.

In the present invention, the given value to be compared to the magnitude of the vibration occurring in the processing roll during the formation of the corrugated medium through the corrugating rolls is a value sufficiently less than a thickness of the corrugated medium. Specifically, when the restriction member comes into contact with the movable part of the supporting mechanism, the magnitude of the vibration occurring in the processing roll is suppressed. The given value is equal to or close to the smallest value of the magnitude of the suppressed vibration.

In the present invention, the control section may be configured to controllably drive the motor until the vibration magnitude is reduced to the given value, to set the gap between the specific corrugating roll and the processing roll, at this time, or may be configured to controllably drive the motor until the vibration magnitude is reduced to the given value, and then further controllably drive the motor to allow the gap to be changed by a given adjustment value.

In a specific preferred embodiment of the first aspect of the present invention, the control section is configured to further execute a second control processing of, on the basis of a reference position defined as a position of the restriction member at a time when the magnitude of the vibration occurring in the processing roll during the formation of the corrugated medium through the corrugating rolls becomes the given value, driving the motor to allow the gap to be changed by a given adjustment value.

In the preferred embodiment having the above feature, the control section executes the first control processing of driving the motor until the magnitude of the vibration occurring in the processing roll during the formation of the corrugated medium through the corrugating rolls is reduced to the given value. The control section further executes a second control processing of, on the basis of a reference position defined as a position of the restriction member at a time when the magnitude of the vibration occurring in the processing roll during the formation of the corrugated medium through the corrugating rolls becomes the given value, driving the motor to allow the gap to be changed by a given adjustment value. Thus, through the first control processing, the gap between the processing roll and the specific corrugating roll is set to the reference value free from influence of the vibration of the processing roll once, and then, through the second control processing, the gap is set to a final value by changing the reference value by the given adjustment value, so that it becomes possible to apply a stable nip pressure free from influence of the vibration of the processing roll, to the corrugated medium and the linerboard or to the corrugated medium.

In this preferred embodiment, the control section may be configured to execute the second control processing in such a manner as to drive the motor to allow the gap to be increased by a given adjustment value, or may be configured to execute the second control processing in such a manner as to drive the motor to allow the gap to be reduced by a given adjustment value.

In a specific preferred embodiment of the first aspect of the present invention, the processing roll is made of a metal material, and the given adjustment value is determined based on a combination of respective thicknesses of the corrugated medium and the linerboard or based on a thickness of the corrugated medium, and wherein the control section is configured to execute the second control processing in such a manner as to, on the basis of a reference position defined as the position of the restriction member at the time when the magnitude of the vibration occurring in the processing roll during the formation of the corrugated medium through the corrugating rolls becomes the given value, drive the motor to allow the gap to be increased by the given adjustment value.

In the preferred embodiment having the above feature, the processing roll is made of a metal material, and the given adjustment value is determined based on a combination of respective thicknesses of the corrugated medium and the linerboard or based on a thickness of the corrugated medium. The control section executes the second control processing in such a manner as to, on the basis of a reference position defined as the position of the restriction member at the time when the magnitude of the vibration occurring in the processing roll during the formation of the corrugated medium through the corrugating rolls becomes the given value, drive the motor to allow the gap to be increased by the given adjustment value. Thus, through the first control processing, the gap between the processing roll and the specific corrugating roll is set to the reference value free from influence of the vibration of the processing roll once, and then, through the second control processing, the gap is set to a final value by increasing the reference value by the given adjustment value, so that it becomes possible to apply a stable nip pressure free from influence of the vibration of the processing roll, to the corrugated medium and the linerboard or to the corrugated medium.

In this preferred embodiment, the given adjustment value determined based on a combination of respective thicknesses of the corrugated medium and the linerboard or based on a thickness of the corrugated medium may be preliminarily stored in a storage device in correlated relation with a thickness of each paperboard, or may be calculated based on a thickness of each paperboard. Generally, a thickness of a paperboard becomes larger along with an increase in basis weight of the paperboard. Thus, a basis weight of a paperboard may be deemed as a property relevant to a thickness of the paperboard, and therefore the above given adjustment value may be determined based on a basis weight of the paperboard.

In a specific preferred embodiment of the first aspect of the present invention, the control section is configured to execute the first control processing in such a manner as to drive the motor with a first torque for displacing the restriction member toward the movable part of the supporting mechanism by a force less than a force by which the pressing actuator section can press the processing roll against the specific corrugating roll, and then after rotation of the motor is first stopped when the restriction member comes into contact with the movable part of the supporting mechanism, successively drive the motor with the first torque until the magnitude of the vibration occurring in the processing roll is reduced to the given value, and to execute the second control processing in such a manner as to drive the motor to allow the gap to be increased by the given adjustment value, with a second torque for displacing the restriction member against the movable part of the supporting mechanism by a force greater than the force by which the pressing actuator section can press the processing roll against the specific corrugating roll.

In the preferred embodiment having the above feature, the control section executes the first control processing in such a manner as to drive the motor with a first torque, and, after rotation of the motor is first stopped, successively drive the motor with the first torque until the magnitude of the vibration is reduced to the given value. Then, the control section executes the second control processing in such a manner as to drive the motor with a second torque to allow the gap to be increased by the given adjustment value. Thus, it is not necessary to detect the vibration of the processing roll while the drive of the motor is controlled by the control section, so that it becomes possible to avoid complication of control processing to be executed by the control section.

In a specific preferred embodiment of the first aspect of the present invention, the given adjustment value determined based on the combination of respective thicknesses of the corrugated medium and the linerboard or based on the thickness of the corrugated medium is a value obtained by subtracting a total thickness of the corrugated medium and the linerboard in a compressed state under a predetermined compression force which is required for compressing the corrugated medium and the linerboard until the magnitude of the vibration occurring in the processing roll during the formation of the corrugated medium through the corrugating rolls becomes the given value, from a total thickness of the corrugated medium and the linerboard in an uncompressed state, or a value obtained by subtracting a thickness of the corrugated medium in a compressed state under a predetermined compression force which is required for compressing the corrugated medium until the magnitude of the vibration occurring in the processing roll during the formation of the corrugated medium through the corrugating rolls becomes the given value, from a thickness of the corrugated medium in an uncompressed state.

In the preferred embodiment having the above feature, the given adjustment value determined based on the combination of respective thicknesses of the corrugated medium and the linerboard or based on the thickness of the corrugated medium is a value obtained by subtracting a total thickness of the corrugated medium and the linerboard in a compressed state under a predetermined compression force which is required for compressing the corrugated medium and the linerboard until the magnitude of the vibration occurring in the processing roll during the formation of the corrugated medium through the corrugating rolls becomes the given value, from a total thickness of the corrugated medium and the linerboard in an uncompressed state, or a value obtained by subtracting a thickness of the corrugated medium in a compressed state under a predetermined compression force which is required for compressing the corrugated medium until the magnitude of the vibration occurring in the processing roll during the formation of the corrugated medium through the corrugating rolls becomes the given value, from a thickness of the corrugated medium in an uncompressed state. Thus, the reference value of the gap is set based on the combination of respective thicknesses of the corrugated medium and the linerboard each compressed by the predetermined compression force or the thickness of the corrugated medium compressed by the predetermined compression force, so that it becomes possible to apply a stable nip pressure free from influence of the vibration of the processing roll, to the corrugated medium and the linerboard or to the corrugated medium.

In this preferred embodiment, the predetermined compression force for compressing the corrugated medium and the linerboard until the magnitude of the vibration occurring in the processing roll during the formation of the corrugated medium through the corrugating rolls becomes the given value, or the predetermined compression force for compressing the corrugated medium until the magnitude of the vibration occurring in the processing roll during the formation of the corrugated medium through the corrugating rolls becomes the given value, is a compression force set through experiment.

In a specific preferred embodiment of the first aspect of the present invention, the processing roll is made of a non-metal material, and the given adjustment value is determined based on a combination of respective properties of the corrugated medium and the linerboard or based on a property of the corrugated medium, and wherein the control section is configured to execute the second control processing in such a manner as to, on the basis of a reference position defined as the position of the restriction member at the time when the magnitude of the vibration occurring in the processing roll during the formation of the corrugated medium through the corrugating rolls form the corrugated medium becomes the given value, drive the motor to allow the gap to be reduced by the given adjustment value.

In the preferred embodiment having the above feature, the processing roll is made of a non-metal material, and the given adjustment value is determined based on combination of respective properties of the corrugated medium and the linerboard or based on a property of the corrugated medium. The control section executes the second control processing in such a manner as to, on the basis of a reference position defined as the position of the restriction member at the time when the magnitude of the vibration occurring in the processing roll during the formation of the corrugated medium through the corrugating rolls becomes the given value, drive the motor to allow the gap to be reduced by the given adjustment value. Thus, through the first control processing, the gap between the processing roll and the specific corrugating roll is set to the reference value free from influence of the vibration of the processing roll once, and then, through the second control processing, the gap is set to a final value by reducing the reference value by the given adjustment value, so that it becomes possible to apply a stable nip pressure free from influence of the vibration of the processing roll, to the corrugated medium and the linerboard or to the corrugated medium.

In this preferred embodiment, the property of the corrugated medium or the linerboard may be a type of paperboard, such as a raw material, a basis weight and a thickness of a paperboard. The given adjustment value may be set in correlated relation with a combination of respective properties of the corrugated medium and the linerboard, or in correlated relation with a property of the corrugated medium. For example, in the case where basis weight is used as the property, the given adjustment value may be preliminarily set at a larger value along with an increase in basis weight. Further, the given adjustment value may be preliminarily stored in a storage device in correlated relation with a property of a paperboard, or may be calculated based on a value of a property of a paperboard, such as basis weight.

In a specific preferred embodiment of the first aspect of the present invention, the control section is configured to execute a processing comprising the first and second control processings, plural times, during a time period where a single-faced corrugated paperboard is produced according to one order.

In the preferred embodiment having the above feature, the control section executes a processing comprising the first and second control processings, plural times, during a time period where a single-faced corrugated paperboard is produced according to one order. Thus, even in a situation where a surrounding environment of the single facer changes during implementation of one order, it becomes possible to apply a stable nip pressure free from influence of the vibration of the processing roll, to the corrugated medium and the linerboard or to the corrugated medium.

In this preferred embodiment, a number of times of the execution of the processing comprising the first and second control processings is determined depending on the surrounding environment of the single facer, such as an ambient temperature around the single facer at a start of an order. For example, in a situation where the surrounding environment at a start of an order is close to that in a steady operation of the single facer, the number of times of the execution of the processing comprising the first and second control processings is reduced.

In a specific preferred embodiment of the first aspect of the present invention, the control section is configured to repeatedly execute the processing comprising the first and second control processings, in such a manner that an interval of execution of the processing comprising the first and second control processings becomes longer in an intermediate stage of implementation of an order, as compared to a starting stage of the implementation of the order.

In the preferred embodiment having the above feature, the control section repeatedly executes the processing comprising the first and second control processings, in such a manner that an interval of execution of the processing comprising the first and second control processings becomes longer in an intermediate stage of implementation of an order, as compared to a starting stage of the implementation of the order. The surrounding environment of the single facer gradually becomes stable after a start of the order. Thus, the interval of execution of the processing comprising the first and second control processings is extended in the intermediate stage of the implementation of the order where the surrounding environment becomes stable. This makes it possible to efficiently execute the control processings.

In this preferred embodiment, the interval of execution of the processing comprising the first and second control processings may be preliminarily stored in a storage device, or may be calculated according to a rising rate of an ambient temperature around the single facer.

In a specific preferred embodiment of the first aspect of the present invention, the single facer further comprises a detection device configured to detect vibration occurring in the processing roll during the formation of the corrugated medium through the corrugating rolls, wherein the control section is configured to execute the first control processing in such a manner as to drive the motor until a magnitude of vibration detected by the detection device is reduced to a given value.

In the preferred embodiment having the above feature, the detection device detects vibration occurring in the processing roll during the formation of the corrugated medium through the corrugating rolls. The control section executes the first control processing according to a magnitude of vibration detected by the detection device. Thus, the restriction member is displaced by the motor, according to the magnitude of the vibration actually detected by the detection device, so that it becomes possible to apply a more stable nip pressure free from influence of the vibration of the processing roll, to the corrugated medium and the linerboard or to the corrugated medium.

In this preferred embodiment, the detection device may have any configuration, as long as the configuration is capable of detecting the vibration occurring in the processing roll. For example, the detection device may be configured to directly detect vibration of the processing roll, or may be configured to indirectly detect vibration of the processing roll, e.g., detect vibration of a member coupled to the processing roll. Further, the detection device may be configured to detect a primary physical vibration of the processing roll or a member coupled to the processing roll, or may be detect a secondary physical vibration generated along with the primary physical vibration.

In a specific preferred embodiment of the first aspect of the present invention, the detection device is configured to detect a rotational change amount of a rotary shaft of the motor, as the vibration occurring in the processing roll, and the control section is configured to execute the first control processing in such a manner as to drive the motor until the rotational change amount of the rotary shaft of the motor is reduced to a given rotational change amount.

In the preferred embodiment having the above feature, the detection device detects a rotational change amount of a rotary shaft of the motor, as the vibration occurring in the processing roll. The control section executes the first control processing in such a manner as to drive the motor until the rotational change amount of the rotary shaft of the motor is reduced to a given rotational change amount. Thus, the detection device can detect the rotational change amount of the rotary shaft of the motor, as the vibration occurring in the processing roll, so that it is not necessary to provide a special detection device in the vicinity of the processing roll.

In this preferred embodiment, due to the vibration of the processing roll, the restriction member and the movable part of the supporting mechanism are repeatedly and alternately placed in a contact state and a separate state. When the restriction member and the movable part of the supporting mechanism are in the separate state during a time period where a drive current is continuously supplied to the motor, the rotary shaft of the motor is rotated. Then, when the restriction member comes into contact with the movable part of the supporting mechanism, the rotation of the rotary shaft of the motor is stepped. The rotational change amount is an amount of rotation in a time period from a start of the rotation of the rotary shaft of the motor through until the rotation of the rotary shaft of the motor is stopped.

In a specific preferred embodiment of the first aspect of the present invention, the detection device is configured to detect a rotation torque of the motor, as the vibration occurring in the processing roll, and the control section is configured to execute the first control processing in such a manner as to drive the motor until a state in which the rotation torque of the motor is increased to a given torque continues for a given time.

In the preferred embodiment having the above feature, the detection device detects a rotation torque of the motor, as the vibration occurring in the processing roll. The control section executes the first control processing in such a manner as to drive the motor until a state in which the rotation torque of the motor is increased to a given torque continues for a given time. Thus, the detection device can detect the rotation torque of the motor as the vibration occurring in the processing roll, so that it is not necessary to provide a special detection device in the vicinity of the processing roll.

In this preferred embodiment, the given torque is a torque with which the motor is driven to displace the restriction member by a force less than the force by which the pressing actuator section can press the processing roll against the specific corrugating roll, and the motor is driven until the magnitude of the vibration occurring in the processing roll is reduced to the given value. The given torque is set through experiment. The given time is longer than a period of the vibration occurring in the processing roll. The given time is set through experiment. The detection device may be configured to detect a value of current supplied to the motor, as the rotation torque of the motor, or may be configured to detect a value of torsion occurring in the rotary shaft of the motor, as the rotation torque of the motor.

In a specific preferred embodiment of the first aspect of the present invention, the processing roll is a press roll made of a non-metal material having elasticity greater than that of the specific corrugating roll.

In the preferred embodiment having the above feature, the processing roll is a press roll made of a non-metal material having elasticity greater than that of the specific corrugating roll. Thus, the press roll is elastically deformed when it is pressed against the specific corrugating roll, so that it becomes possible to suppress the formation of a press mark in a single-faced corrugated paperboard.

In a specific preferred embodiment of the first aspect of the present invention, the restricting mechanism further comprises: an externally-threaded shaft configured to be rotated by the motor; and a movable member formed to have an inclined surface and configured to be moved along the externally-threaded shaft while being threadingly engaged with the externally-threaded shaft, wherein the restriction member is formed to have an inclined surface being in sliding contact with the inclined surface of the movable member, and configured to be moved in a direction perpendicular to the externally-threaded shaft, in such a manner as to come into contact with the movable part of the supporting mechanism.

In the preferred embodiment having the above feature, the externally-threaded shaft is rotated by the motor, and the movable member threadingly engaged with the externally-threaded shaft is moved along the externally-threaded shaft. In the state in which the inclined surface of the restriction member is in sliding contact with the inclined surface of the movable member, the restriction member is moved in the direction perpendicular to the externally-threaded shaft, in such a manner as to come into contact with the movable part of the supporting mechanism. Thus, once the restriction member is positioned, a restriction position of the restriction member can be maintained without supplying a drive current to the motor.

In a specific preferred embodiment of the first aspect of the present invention, the supporting mechanism comprises a swingable member attached to a frame in such a manner as to be swingingly movable about a given swing axis, while supporting the processing roll, wherein the pressing actuator section is coupled to the swingable member to press the processing roll against the specific corrugating roll, and the restriction member is disposed in contactable relation to a part of the swingable member, at a position farther away from the given swing axis than a position where the processing roll is supported by the swingable member.

In the preferred embodiment having the above feature, the swingable member is attached to a frame in such a manner as to be swingingly movable about a given swing axis, while supporting the processing roll. The pressing actuator section is coupled to the swingable member to push the swingable member the processing. The restriction member can come into contact with a part of the swingable member, at a position farther away from the given swing axis than a position where the processing roll is supported by the swingable member. Thus, as compared to a configuration in which the restriction member comes into contact with a part of the swingable member, at a position closer to the given swing axis than the position where the processing roll is supported by the swingable member, it becomes possible to finely adjust the gap between the processing roll and the specific corrugating roll, when the restriction member is moved by the same distance.

In this preferred embodiment, the part of the swingable member is not limited to a portion of the swingable member, but may include a member supported by the swingable member, as long as the supported member can be swingably moved integrally with the swingable member.

Second Aspect of the Present Invention and Preferred Embodiments Thereof

In order to achieve the above object, according to the second aspect of the present invention, there is provided a single facer for producing a single-faced corrugated paperboard by forming a corrugated medium and gluing a linerboard onto the corrugated medium. The single facer comprises: a pair of corrugating rolls configured to form the corrugated medium; a processing roll configured to be brought into contact with a specific one of the corrugating rolls through the corrugated medium and the linerboard or through the corrugated medium so as to perform a given processing; first and second supporting mechanisms each supporting a respective one of opposite ends of a rotary shaft of the processing roll in such a manner as to allow a gap between the specific corrugating roll and the processing roll to be changed, wherein at least a part of each of the first and second supporting mechanisms is configured to be movable to cause a change in the gap; a pressing actuator section configured to press the processing roll against the specific corrugating roll through the corrugated medium and the linerboard or through the corrugated medium; first and second restricting mechanisms each provided for a respective one of the first and second supporting mechanisms, wherein each of the first and second restricting mechanisms comprises a restriction member disposed in contactable relation to the movable part of a respective one of the first and second supporting mechanisms, wherein the restricting mechanism is configured to allow the restriction member to be displaced with respect to the movable part of the supporting mechanism; first and second motors each provided for a respective one of the first and second restricting mechanisms and configured to be driven so as to displace a corresponding one of the restriction members; and a control section for controlling the drive of the first and second motors, wherein the control section is configured to execute a first control processing of driving the first and second motors until a magnitude of vibration occurring in the processing roll during the formation of the corrugated medium through the corrugating rolls is reduced to a given value.

In the second aspect of the present invention, each of the first and second restricting mechanisms is provided for a respective one of the first and second supporting mechanisms, and each of the first and second restricting mechanisms comprises a restriction member disposed in contactable relation to the movable part of a respective one of the first and second supporting mechanisms. The restricting mechanism is configured to allow the restriction member to be displaced with respect to the movable part of the supporting mechanism. Each of the first and second motors is provided for a respective one of the first and second restricting mechanisms and configured to be driven so as to displace a corresponding one of the restriction members. The control section executes a first control processing of driving the first and second motors until a magnitude of vibration occurring in the processing roll during the formation of the corrugated medium through the corrugating rolls is reduced to a given value. Thus, through the first control processing, the gap between the processing roll and the specific corrugating roll is set to a reference value free from influence of the vibration of the processing roll, so that it becomes possible to apply a stable nip pressure free from influence of the vibration of the processing roll, to the corrugated medium and the linerboard or to the corrugated medium, by the entire region of the processing roll in its axial direction.

The second aspect of the present invention can be variously embodied as with the first aspect of the present invention. The single facer according to the second aspect of the present invention may comprise a detection device configured to detect the vibration of the processing roll. In this case, the detection device may be configured to detect the vibration of the processing roll at one point of the processing roll, or may be configured to detect the vibration of the processing roll at two point of the processing roll spaced apart from each other in the axial direction.

In a specific preferred embodiment of the second aspect of the present invention, the single facer further comprises first and second detection devices each configured to detect vibration occurring in a respective one of the opposite ends of the rotary shaft of the processing roll during the formation of the corrugated medium through the corrugating rolls, wherein the control section is configured to execute the first control processing in such a manner as to drive each of the first and second motors according to a respective one of vibration magnitudes detected by the first and second detection devices.

In the preferred embodiment having the above feature, each of the first and second detection devices detects the vibration occurring in a respective one of the opposite ends of the rotary shaft of the processing roll. The control section executes the first control processing in such a manner as to drive each of the first and second motors according to a respective one of vibration magnitudes detected by the first and second detection devices. Thus, the first control processing for the motor is executed according to vibrations actually detected by the first and second detection devices, so that it becomes possible to apply a more stable nip pressure free from influence of the vibration of the processing roll, to the corrugated medium and the linerboard or to the corrugated medium, by the entire region of the processing roll in the axial direction.

In this preferred embodiment, the control section may execute a control processing for controlling the drive of the motors, in various manners. For example, the control section may be configured to execute the first and second control processings for controlling the drive of the first motor, and the first and second control processings for controlling the drive of the second motor, in a parallel way in terms of the first and second motors, or may be configured to execute the first control processing for controlling the drive of the first and second motors and then execute the second control processing for controlling the drive of the first and second motors, in a parallel way in terms of the first and second motors.

DESCRIPTION OF EMBODIMENTS

First Embodiment

With reference to FIGS. 1 to 8, a single facer according to a first embodiment of the present invention will be described. In the figures, an up-down direction, a right-left direction and a front-rear direction are defined according to respective directions indicated by the arrowed lines.

<General Configuration>

Figure 1:
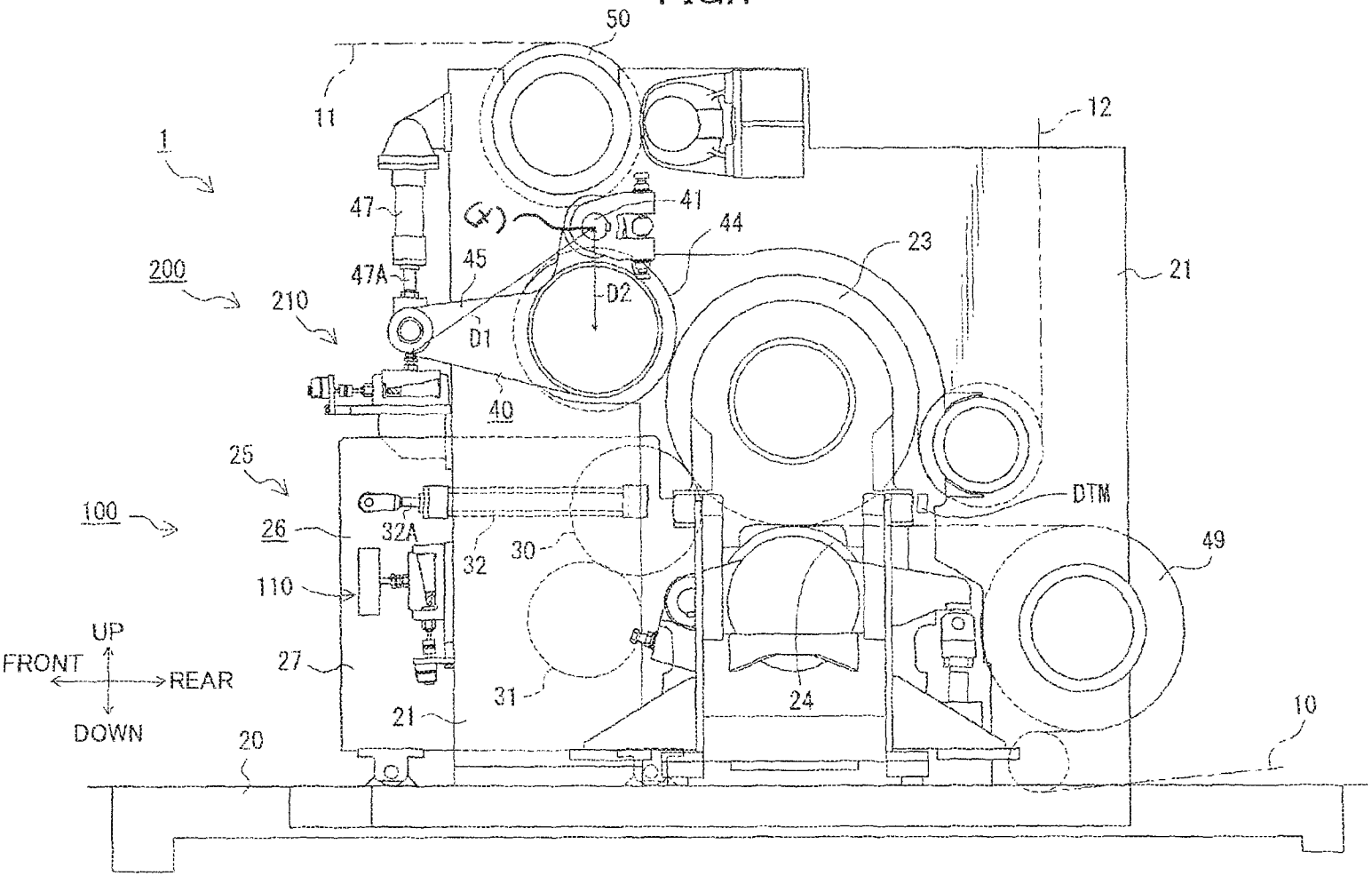
FIG. 1 is a right side view of a single facer according to a first embodiment of the present invention.
Figure 2:
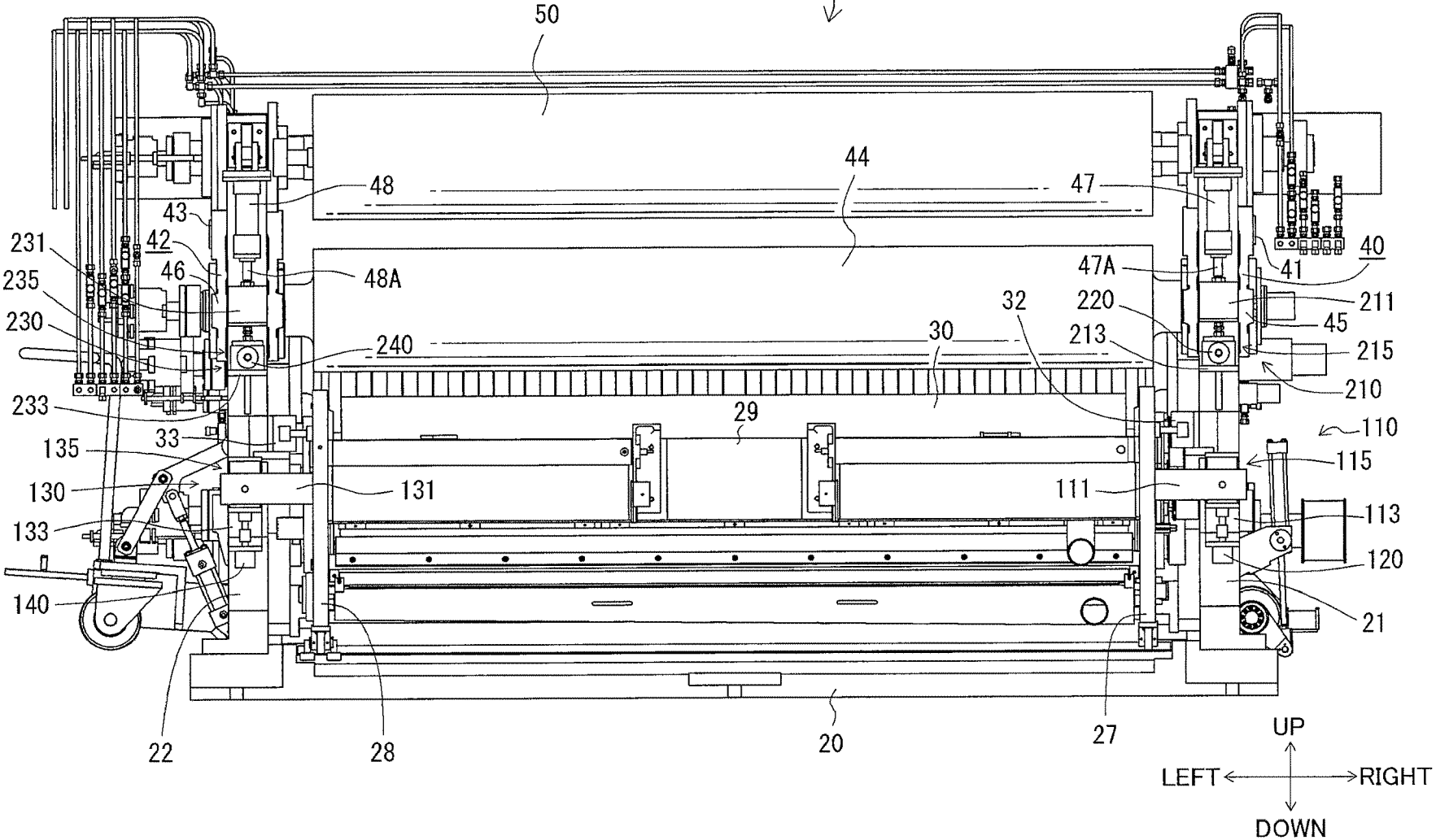
FIG. 2 is a front view of the single facer according to the first embodiment.

FIG. 1 illustrate a general configuration of a single facer 1 according to the first embodiment. The single facer 1 is designed to produce a single-faced corrugated paperboard 12 by forming a medium 10 into a corrugated configuration and gluing a linerboard 11 onto the corrugated medium 10. A configuration of the single facer 1 has heretofore been known as disclosed, for example, in JP 2000-102996A. Thus, in particular, a configuration pertaining to a gap adjusting mechanism will be described in detail. The single facer 1 comprises a base 20, and right and left stationary frames 21, 22 each standing upwardly from the base 20. The stationary frames 21, 22 rotatably support an upper corrugating roll 23 and a lower corrugating roll 24. Each of the corrugating rolls 23, 24 has a corrugated-shaped fluted portion formed on an outer peripheral surface thereof. The corrugating rolls 23, 24 are arranged to allow the corrugated-shaped fluted portions of them to be meshed with each other to thereby form the medium 10 into a corrugated configuration. Each of the corrugating rolls 23, 24 is configured to be internally supplied with stream. Each of the corrugating rolls 23, 24 is made of a metal material such as chromium molybdenum steel. A temperature sensor DTM is disposed in adjacent relation to the corrugating rolls 23, 24, and configured to detect an internal temperature of the single facer 1.

The single facer 1 is equipped with a glue application apparatus 25. The glue application apparatus 25 comprises a movable frame 26 movable on the base 20 in a front-rear direction. The movable frame 26 has a right support plate portion 27, a left support plate portion 28, and a beam member 29 disposed to extend between the support plate portions 27, 28. Each of the support plate portions 27, 28 is disposed to extend perpendicularly with respect to the base 20, and provided with a roller rollingly movable on the base 20. The glue application apparatus 25 further comprises a glue roll 30 and a doctor roll 31. The glue roll 30 is partially immersed in a glue pan reserving glue therein, and configured to apply glue onto flute tip regions of the corrugated medium 10 formed by the corrugating rolls 23, 24. The doctor roll 31 is configured to scrapingly uniform a thickness of glue adhering on an outer peripheral surface of the glue roll 30. Each of the glue roll 30 and the doctor roll 31 is rotatably supported by the support plate portions 27, 28. Generally, the glue roll 30 is made of a metal material such as carbon steel, and formed in a pipe shape.

A right glue-application hydraulic cylinder 32 is attached to a left surface of the right stationary frame 21, and comprises an extendable-retractable actuating rod 32A. The actuating rod 32A has a front end coupled to a right surface of the right support plate portion 27. A left glue-application hydraulic cylinder 33 is attached to a right surface of the left stationary frame 22, and comprises an extendable-retractable actuating rod. The actuating rod of the hydraulic cylinder 33 has a front end coupled to a left surface of the left support plate portion 28. The glue-application hydraulic cylinders 33 are operable to pull the movable frame 26 rearwardly to cause the glue roll 30 to be pressed against the upper corrugating roll 23 through the corrugated medium 10.

A right swingable frame 40 is swingingly movably attached to the right stationary frame 21 via a pivot shaft 41. A left swingable frame 42 is swingingly movably attached to the left stationary frame 22 via a pivot shaft 43. The right swingable frames 40, 42 rotatably support a press roll 44. The press roll 44 is configured to press the corrugated medium and the linerboard 11 toward the upper corrugating roll 23 so as to gluingly laminate the linerboard 11 to the glue-applied flue tip regions of the corrugated medium 10. The right swingable frame 40 has a forwardly-extending arm portion 45, and the left swingable frame 42 has a forwardly-extending arm portion 46. Generally, the press roll 44 is made of a metal material such as carbon steel.

A right press hydraulic cylinder 47 is attached to a front end of the right stationary frame 21, and equipped with an extendable-retractable actuating rod 47A. The actuating rod 47A has a lower end coupled to a front end of the arm portion 45 of the right swingable frame 40. A left press hydraulic cylinder 48 is attached to a front end of the left stationary frame 22, and equipped with an extendable-retractable actuating rod 48A. The actuating rod 48A has a lower end coupled to a front end of the arm portion 46 of the left swingable frame 42. The press hydraulic cylinders 47, 48 are operable to rotationally urge the respective swingable frames 40, 42 in a counterclockwise direction about the respective pivot shafts 41, 43 to cause the press roll 44 to be pressed against the upper corrugating roll 23 through the corrugated medium 10 and the linerboard 11.

The medium 10 is conveyed to a position where the corrugated-shaped fluted portions of the corrugating rolls 23, 24 are meshed with each other, via a preheater 49. The linerboard 11 is conveyed to the press roll 44 via a preheater 50. The corrugated medium 10 is applied with glue by the glue roll 30, and then gluingly laminated with the linerboard 11 by the press roll 44, to form the single-faced corrugated paperboard 12. The single-faced corrugated paperboard 12 is conveyed while being wound around the outer peripheral surface of the upper corrugating roll 23, and discharged toward an upper side of the single facer 1.

The single facer 1 is further equipped with a glue-roll gap adjustment apparatus 100 for adjusting a gap between the glue roll 30 and the upper corrugating roll 23, and a press-roll gap adjustment apparatus 200 for adjusting a gap between the press roll 44 and the upper corrugating roll 23.

<Detailed Configuration of Glue-Roll Gap Adjustment Apparatus 100>

The glue-roll gap adjustment apparatus 100 comprises a right glue-roll gap adjusting mechanism 110 and a left glue-roll gap adjusting mechanism 130. The right glue-roll gap adjusting mechanism 110 is disposed between the right stationary frame 21 and the right support plate portion 27, and the left glue-roll gap adjusting mechanism 130 is disposed between the left stationary frame 22 and the left support plate portion 28. The right and left glue-roll gap adjusting mechanisms 110, 130 have the same configuration. Thus, only the configuration of the right glue-roll gap adjusting mechanism 110 will be described in detail, as a representative example.

Figure 3:
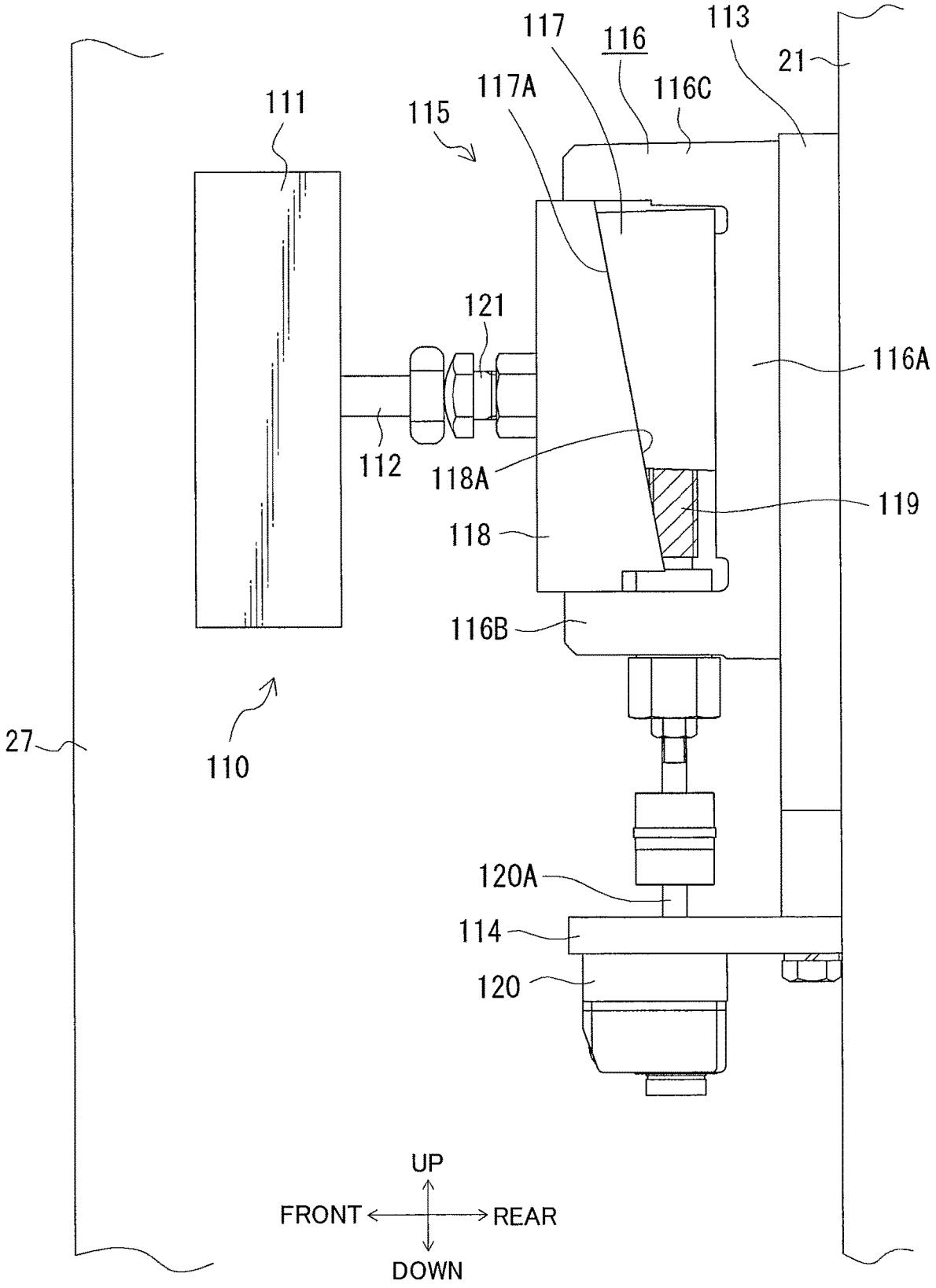
FIG. 3 is an enlarged right side view illustrating a glue-roll gap adjusting mechanism for adjusting a gap between a glue roll and an upper corrugating roll in the single facer according to the first embodiment.

FIG. 3 is a right side view enlargedly illustrating a general configuration of the right glue-roll gap adjusting mechanism 110. In FIG. 3, a fixed block 111 is fixed to the right surface of the right support plate portion 27, in such a manner as to extend rightwardly from the right surface of the right support plate portion 27. A contact member 112 is fixed onto a rear surface of the fixed block 111 in such a manner as to protrude rearwardly from the rear surface of the fixed block 111. On the other hand, a holder 113 is fixed onto a front end surface of the right stationary frame 21 in such a manner as to extend forwardly. A leveling block 115 is fixed to the holder 113. The leveling block 115 primarily comprises a casing 116, a pair of first and second wedge-shaped bodies 117, 118, and an externally-threaded shaft 119. The first and second wedge-shaped bodies 117, 118 are disposed inside the casing 116. The first wedge-shaped body 117 is formed to have an inclined surface 117A, and configured to be slidingly moved on a wall surface of a wall portion 116A of the casing 116, wherein the wall portion 116A extends in an up-down direction. The second wedge-shaped body 118 is formed to have an inclined surface 118A being in sliding contact with the inclined surface 117A, and configured to be displaced in the front-rear direction while being guided by a pair of opposed wall portions 116B, 116C of the casing 116, wherein each of the wall portions 116B, 116C extends forwardly. The externally-threaded shaft 119 is disposed to extend upwardly from the wall portion 116B, and threadingly engaged with an internally-threaded portion formed inside the first wedge-shaped body 117. As regards the leveling block 115, various types of products are commercially available. For example, it is commercially supplied from NABEYA Co., Ltd., as a model number: Leveling Block A-type. Further, a fundamental configuration of the leveling block has heretofore been known as disclosed, for example, in JP 2008-087139 A.

A servomotor 120 is fixed to a support wall member 114. The servomotor 120 has an output shaft 120A coupled to the externally-threaded shaft 119 via a coupling member. The servomotor 120 incorporates an encoder EC 11 for detecting rotation of the output shaft 120A.

An adjusting screw 121 is installed in a front end surface of the second wedge-shaped body 118 in such a manner as to be threadingly engaged with an internally-threaded portion formed inside the second wedge-shaped body 118. An amount of protrusion of the adjusting screw 121 protruding forwardly from the front end surface of the second wedge-shaped body 118 can be manually adjusted by an operator. A head of the adjusting screw 121 is disposed in opposed relation to and in contactable relation to a distal end of the contact member 112.

As with the right glue-roll gap adjusting mechanism 110, the left glue-roll gap adjusting mechanism 130 comprises a fixed block 131, a contact member, a holder 133, a leveling block 135, a servomotor 140 incorporating an encoder EC12, and an adjusting screw.

<Detailed Configuration of Press-Roll Gap Adjustment Apparatus 200>

The press-roll gap adjustment apparatus 200 comprises aright press-roll gap adjusting mechanism 210 and a left press-roll gap adjusting mechanism 230. The right press-roll gap adjusting mechanism 210 is disposed between the right stationary frame 21 and arm portion 45 of the right swingable frame 40, and the left press-roll gap adjusting mechanism 230 is disposed between the left stationary frame 22 and arm portion 46 of the left swingable frame 42. The right and left press-roll gap adjusting mechanisms 210, 230 have the same configuration. Thus, details of the configuration will be described by taking the right press-roll gap adjusting mechanism 210 as an example.

Figure 4:
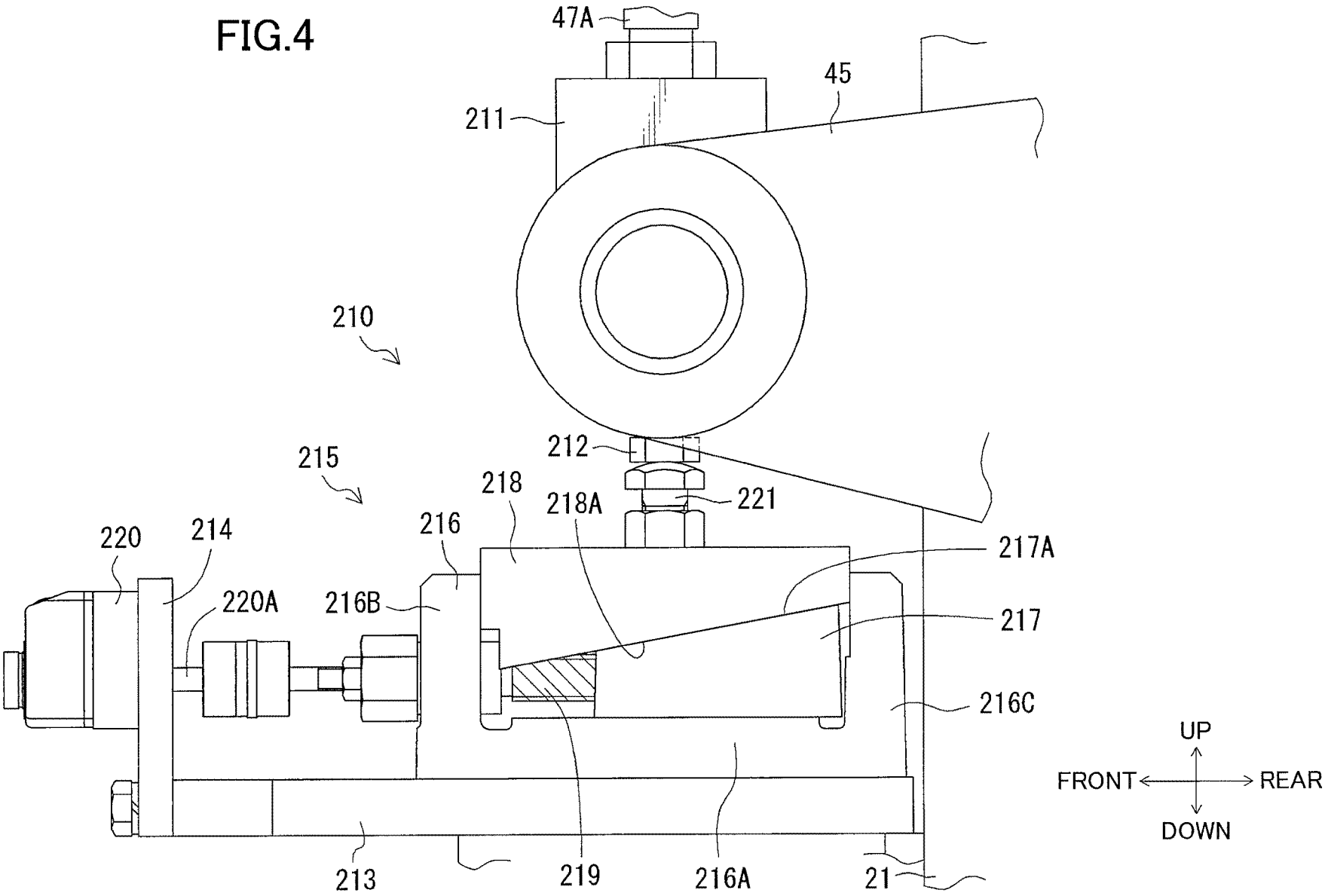
FIG. 4 is an enlarged right side view illustrating a press-roll gap adjusting mechanism for adjusting a gap between a press roll and the upper corrugating roll in the single facer according to the first embodiment.

FIG. 4 is a right side view enlargedly illustrating a general configuration of the right press-roll gap adjusting mechanism 210. In FIG. 4, a coupling block 211 is provided to couple the lower end of the actuating rod 47A of the right press hydraulic cylinder 47 to the distal (front) end of the arm portion 45. Further, a contact member 212 is fixed to a lower end of the coupling block 211 in such a manner as to protrude downwardly from the lower end of the coupling block 211. As illustrated in FIG. 1, a distance D1 between the contact member 212 and an axis (X) of the pivot shaft 41 is set to be greater than a distance D2 between a rotation center of the press roll 44 and the axis (X) of the pivot shaft 41. On the other hand, a holder 213 is fixed onto the front end surface of the right stationary frame 21 in such a manner as to extend upwardly. A leveling block 215 is fixed to the holder 213. The leveling block 215 primarily comprises a casing 216, a pair of third and fourth wedge-shaped bodies 217, 218, and an externally-threaded shaft 219. The third and fourth wedge-shaped bodies 217, 218 are disposed inside the casing 216. The third wedge-shaped body 217 is formed to have an inclined surface 217A, and configured to be slidingly moved on a wall surface of a wall portion 216A of the casing 216, wherein the wall portion 216A extends in the front-rear direction. The fourth wedge-shaped body 218 is formed to have an inclined surface 218A being in sliding contact with the inclined surface 217A, and configured to be displaced in the up-down direction while being guided by a pair of opposed wall portions 216B, 216C of the casing 216, wherein each of the wall portions 216B, 216C extends upwardly. The externally-threaded shaft 219 is disposed to extend rearwardly from the wall portion 216B, and threadingly engaged with an internally-threaded portion formed inside the third wedge-shaped body 217. The leveling block 215 has the same configuration as the leveling block 115 of the right glue-roll gap adjusting mechanism 110.

A servomotor 220 is fixed to a support wall member 214. The servomotor 220 has an output shaft 220A coupled to the externally-threaded shaft 219 via a coupling member. The servomotor 220 incorporates an encoder EC21 for detecting rotation of the output shaft 220A.

An adjusting screw 121 is installed in an upper end surface of the fourth wedge-shaped body 218 in such a manner as to be threadingly engaged with an internally-threaded portion formed inside the fourth wedge-shaped body 218. An amount of protrusion of the adjusting screw 221 protruding upwardly from the upper end surface of the fourth wedge-shaped body 218 can be manually adjusted by an operator. A head of the adjusting screw 221 is disposed in opposed relation to and in contactable relation to a distal end of the contact member 212.

As with the right press-roll gap adjusting mechanism 210, the left press-roll gap adjusting mechanism 230 comprises a coupling block 231, a contact member, a holder 233, a leveling block 235, a servomotor 240 incorporating an encoder EC22, and an adjusting screw.

<<Electrical Configuration>>

Figure 5:
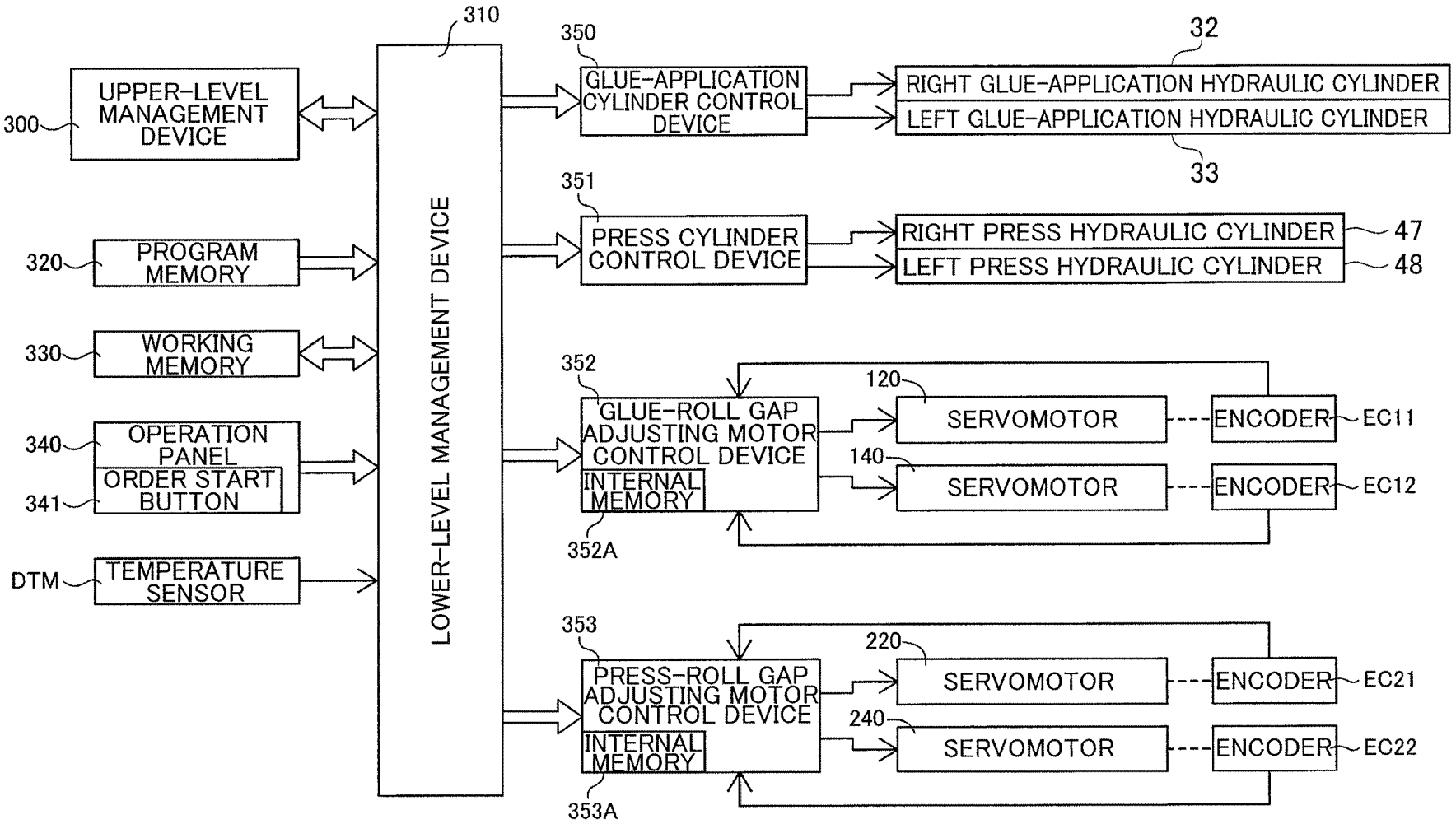
FIG. 5 is a block diagram illustrating an electrical configuration of the single facer according to the first embodiment.

With reference to FIG. 5, an electrical configuration of the single facer 1 according to the first embodiment will be described below. FIG. 5 is a block diagram illustrating the electrical configuration of the single facer 1 according to the first embodiment. As illustrated in FIG. 5, an upper-level management device 300 is provided to generally manage production of a single-faced corrugated paperboard in the single facer 1. The upper-level management device 300 is configured to send, to a lower-level management device 310, control instruction information about a rotational speed of a main drive motor, an amount of production of single-faced corrugated paperboards, a type of paperboard such as a thickness of a paperboard, etc., according to a production management plan regarding a large number of predetermined orders.

The lower-level management device 310 is configured to instruct various control devices to control drive sections for the hydraulic cylinders, the servomotors, the preheaters, etc., according to the control instruction information received from the upper-level management device 300. In the second embodiment, only an electrical configuration pertaining to operations of the glue-roll gap adjustment apparatus 100 and the press-roll gap adjustment apparatus 200 will be described.

A program memory 320 fixedly stores therein programs such as a main control routine of the single facer 1, an adjustment instruction routine for determining a timing of generating an instruction for a start of gap adjustment control, and fixedly stores therein various preset values. A working memory 330 is configured to temporarily store therein a result of processing by the lower-level management device 310. An operation panel 340 is connected to the lower-level management device 310. The operation panel 340 has an order start button 341. The order start button 341 is a button to be manually operated by an operator in order to start to implement one order. The temperature sensor DTM is connected to the lower-level management device 310, and configured to send a temperature detection signal indicative of an internal temperature of the single facer 1 to the lower-level management device 310.

For example, as the preset values, the program memory 320 stores therein a hydraulic pressure value for the glue roll 30, a hydraulic pressure value for the press roll 44, a given glue-roll vibration threshold value, a given press-roll vibration threshold value, a glue-roll gap adjustment value, a press-roll gap adjustment value, first and second torque values for adjusting a glue-roll gap, and first and second torque values for adjusting a press-roll gap, in correlated relation with a type of paperboard, such as a raw material and a thickness of a paperboard. The lower-level management device 310 is configured to, among the control instruction information sent from the upper-level management device 300 according to each order, read various preset values correlated with a type of paperboard from the program memory 320, and send the preset values to each control device. In the first embodiment, the glue-roll gap adjustment value for the glue roll 30 is stored in correlated relation with a thickness of the corrugated medium 10, and the press-roll gap adjustment value for the press roll 44 is stored in correlated relation with a combination of respective thickness of the corrugated medium 10 and the linerboard 11. Generally, each of the glue-roll gap adjustment value and the press-roll gap adjustment value is set to a larger value along with an increase in thickness of a paperboard for the corrugated medium, etc.

A glue-application cylinder control device 350 is connected to the lower-level management device 310, and configured to control operation of the right and left right glue-application hydraulic cylinders 32, 33, according the control instruction information including a hydraulic pressure value, received from the lower-level management device 310. A level of hydraulic pressure to be generated by each of the glue-application hydraulic cylinders 32, 33 is instructed by the hydraulic pressure value for the glue roll 30, received from the lower-level management device 310. A press cylinder control device 351 is connected to the lower-level management device 310, and configured to control operation of the right press hydraulic cylinders 47, 48, according the control instruction information including a hydraulic pressure value, received from the lower-level management device 310. A level of hydraulic pressure to be generated by each of the press hydraulic cylinders 47, 48 is instructed by the hydraulic pressure value for the press roll 44, received from the lower-level management device 310.

A glue-roll gap adjusting motor control device 352 is connected to the lower-level management device 310, and configured to control a rotation direction and a drive current of each of the servomotors 120, 140, according the control instruction information from the lower-level management device 310. Specifically, the glue-roll gap adjusting motor control device 352 is configured to control the rotation direction and the drive current of the servomotor 120, based on the control instruction information from the lower-level management device 310 and detection pulses from the encoder EC11. The gap between the glue roll 30 and the upper corrugating roll 23 is instructed by the glue-roll gap adjustment value from the lower-level management device 310. Further, the glue-roll gap adjusting motor control device 352 is configured to control a rotation direction and a drive current of the servomotor 140, based on the control instruction information from the lower-level management device 310 and the detection pulses from the encoder EC12. The glue-roll gap adjusting motor control device 352 fixedly stores in an internal memory 352A an adjustment control routine to perform glue-roll gap adjustment control, wherein it is configured to execute the adjustment control routine according to a timing instruction from the lower-level management device 310. The glue-roll gap adjusting motor control device 352 is composed of a computer comprising the internal memory 352A.

A press-roll gap adjusting motor control device 353 is connected to the lower-level management device 310, and configured to control a rotation direction and a drive current of each of the servomotors 220, 240, according the control instruction information from the lower-level management device 310. Specifically, the press-roll gap adjusting motor control device 353 is configured to control the rotation direction and the drive current of the servomotor 220, based on the control instruction information from the lower-level management device 310 and the detection pulses from the encoder EC21. The gap between the press roll 44 and the upper corrugating roll 23 is instructed by the press-roll gap adjustment value from the lower-level management device 310. Further, the press-roll gap adjusting motor control device 353 is configured to control a rotation direction and a drive current of the servomotor 240, based on the control instruction information from the lower-level management device 310 and the detection pulses from the encoder EC22. The press-roll gap adjusting motor control device 353 fixedly stores in an internal memory 353A an adjustment control routine to perform press-roll gap adjustment control, wherein it is configured to execute the adjustment control routine according to a timing instruction from the lower-level management device 310. The press-roll gap adjusting motor control device 353 is composed of a computer comprising the internal memory 353A.

<<Operation and Functions of Single Facer According to First Embodiment>>

An operation and functions of the single facer 1 according to the first embodiment will be described below. In the single facer 1, during the formation of the corrugated medium 10 through the corrugating rolls 23, 24, each of the glue roll 30 and the press roll 44 periodically comes into contact with one or more ridges of the fluted portion of the upper corrugating roll 23, through the corrugated medium 30 or through the corrugated medium 30 and the linerboard 11, so that the periodic contacts cause vibration in each of the press roll and the glue roll. Further, in the single facer 1, the formation of the corrugated medium 10 through the corrugating rolls 23, 24, steam is fed into at least the corrugating rolls 23, 24 to heat the corrugating rolls 23, 24, and thereby an inside of the single facer 1 has a high temperature, which causes thermal strain in components of the single facer 1. Therefore, it is necessary to accurately adjust the gap between the glue roll 30 and the upper corrugating roll 23 and the gap between the press roll 44 and the upper corrugating roll 23, while maximally avoiding an influence of the thermal strain on the components.

<Vibrations Occurring in Glue Roll 30 and Press Roll 44>

Figure 6:
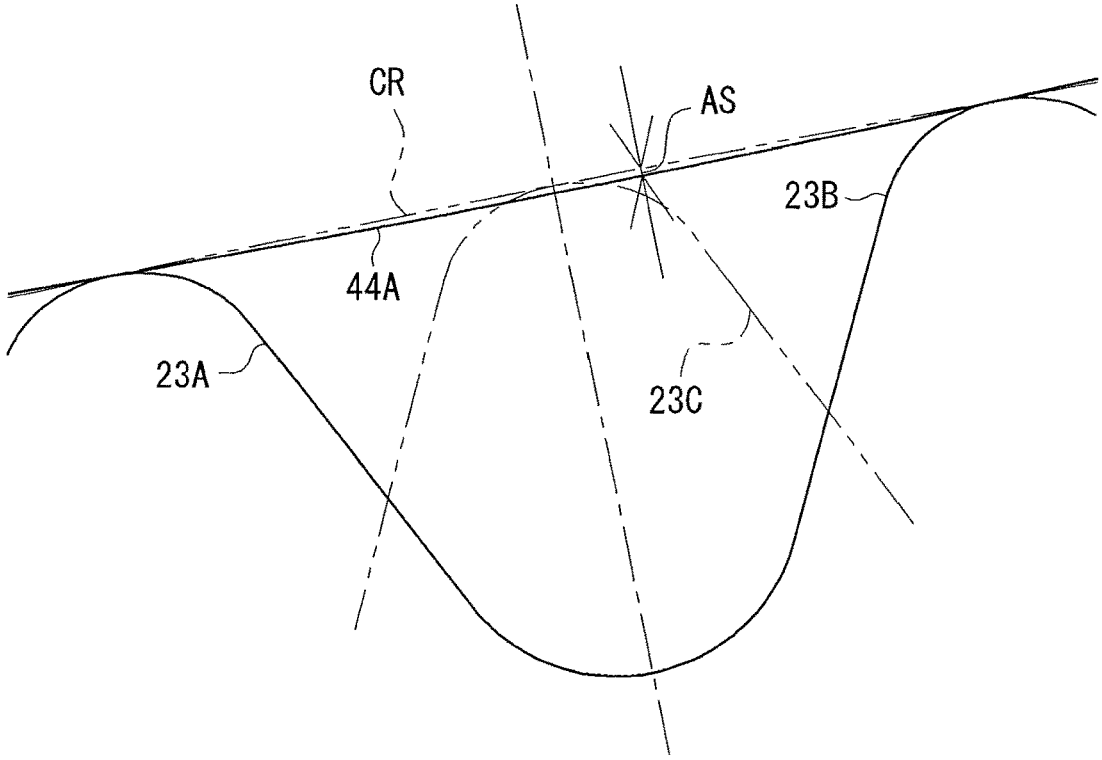
FIG. 6 is an explanatory diagram enlargedly illustrating a contact state between an outer peripheral surface of the press roll and ridges of a fluted portion of the upper corrugating roll.

With reference to FIG. 6, vibrations occurring in the glue roll 30 and the press roll 44 will be described. A mechanism for causing vibration to occur in the glue roll 30 and a mechanism for causing vibration to occur in the press roll 44 are the same in that both of the vibrations occur due to the periodic contacts with the upper corrugating roll 23. FIG. 6 enlargedly illustrates a contact state between ridges of the fluted portion of the upper corrugating roll 23 and the press roll 44.

In FIG. 6, an outer peripheral surface 44A of the press roll 44 is in contact with two adjacent ridges 23A, 23B of the fluted portion of the upper corrugating roll 23. A circle CR connecting tops of all ridges of the fluted portion of the upper corrugating roll 23 is indicated by the two-dot chain line in FIG. 6. In a state in which the outer peripheral surface 44A of the press roll 44 is in contact with the ridges 23A, 23B of the fluted portion of the upper corrugating roll 23, the outer peripheral surface 44A penetrates across the circle CR toward a center of the upper corrugating roll 23. A penetration amount AS of the outer peripheral surface 44A indicated in FIG. 6 is determined depending on a diameter of the press roll 44. When the upper corrugating roll 23 is rotated, and the outer peripheral surface 44A comes into contact with a ridge 23C indicated by the two-dot chain line in FIG. 6, the outer peripheral surface 44A is moved outwardly and located on the circle CR. As a result, due to the periodic contacts of the outer peripheral surface 44A with one or more ridges of the fluted portion of the upper corrugating roll 23, the press roll 44 vibrates at an amplitude equivalent to the penetration amount AS.

As with the press roll 44, the outer peripheral surface of the glue roll 30 periodically comes into contact with one or more ridges of the fluted portion of the upper corrugating roll 23, and therefore vibrates. An amplitude of the vibration of the glue roll 30 is determined depending on a diameter of the glue roll 30.

<Timing Instruction according to Adjustment Instruction Routine>

Figure 7:
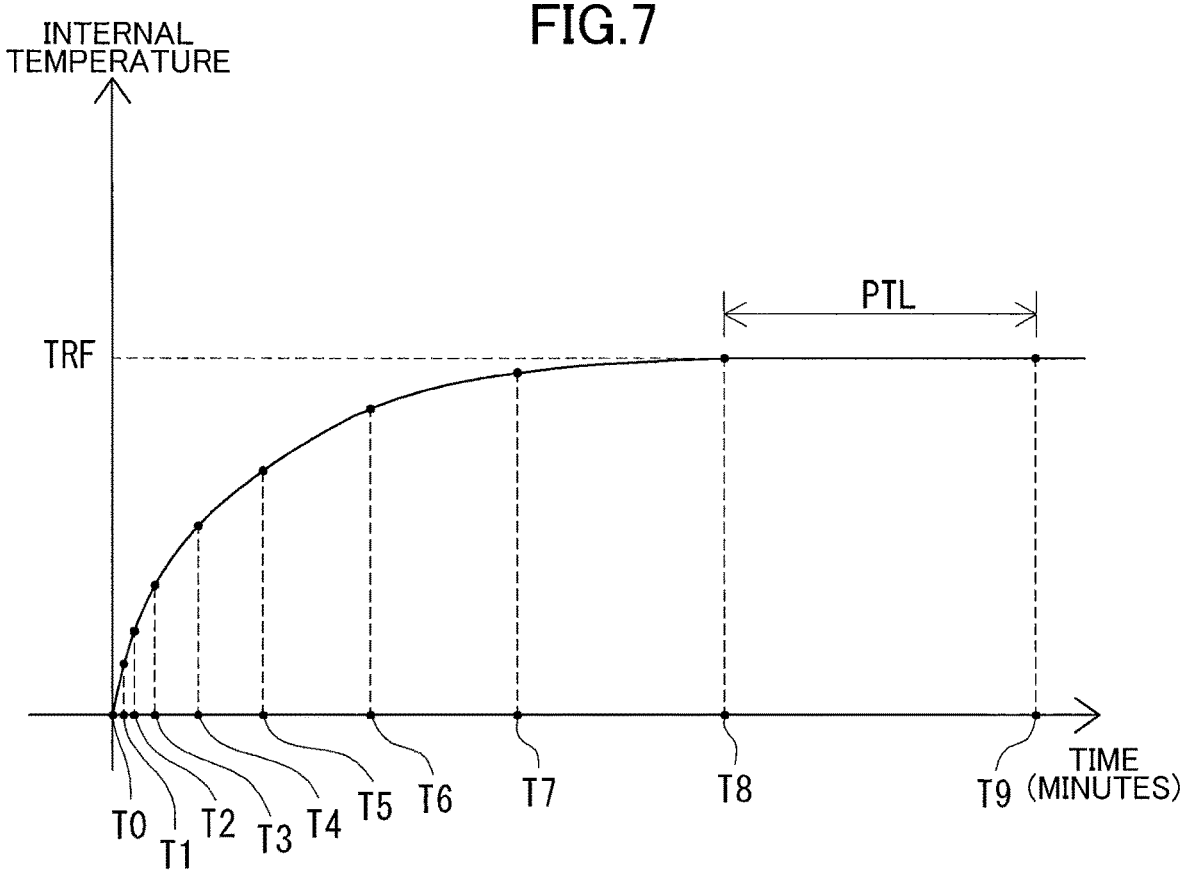
FIG. 7 is an explanatory diagram illustrating a relationship between an internal temperature of the single facer, and a time point of a timing instruction to be generated by a lower-level management device in the single facer according to the first embodiment.

With reference to FIG. 7, processing of the adjustment instruction routine for determining a timing of generating an instruction for a start of the gap adjustment control will be described. FIG. 7 illustrates a relationship between an internal temperature of the single facer 1 and a time point of generation of the timing instruction. When an operator manually operates the order start button 341, the lower-level management device 310 reads the adjustment instruction routine from the program memory 320 and executes the adjustment instruction routine. The execution of the adjustment instruction routine will be terminated when implementation of an order is completed.

According to a temperature detection signal from the temperature sensor DTM, the lower-level management device 310 determines whether or not an internal temperature change amount in the single facer 1 is equal to or greater than a given temperature change amount. When it is determined that the internal temperature change amount is equal to or greater than the given temperature change amount, the lower-level management device 310 instructs each of the glue-roll gap adjusting motor control device 352 and the press-roll gap adjusting motor control device 353 to start the gap adjustment control. In FIG. 7, in a time period from order start time point T0 to time point T6, the internal temperature of the single facer 1 is rapidly increased, and therefore the lower-level management device 310 generates the timing instruction for the start of the gap adjustment control, at respective time points T1 to T6, at relatively short time intervals.

According to the temperature detection signal from the temperature sensor DTM, the lower-level management device 310 also determines whether or not the internal temperature of the single facer 1 has been increased to a reference temperature TRF set for production of the single-faced corrugated paperboard 12. When it is determined that the internal temperature of the single facer 1 has been increased to the reference temperature TRF, the lower-level management device 310 generates the timing instruction at given time intervals PTL. The given time interval PTL is longer than each of a plurality of different time intervals at which the timing instruction is generated in the time period from the time point T0 to the time point T8. In the first embodiment, the given temperature change amount and the given time interval PTL are fixedly stored in the program memory 320 as the various preset values.

<Gap Adjustment Control according to Adjustment Control Routine>

Figure 8:
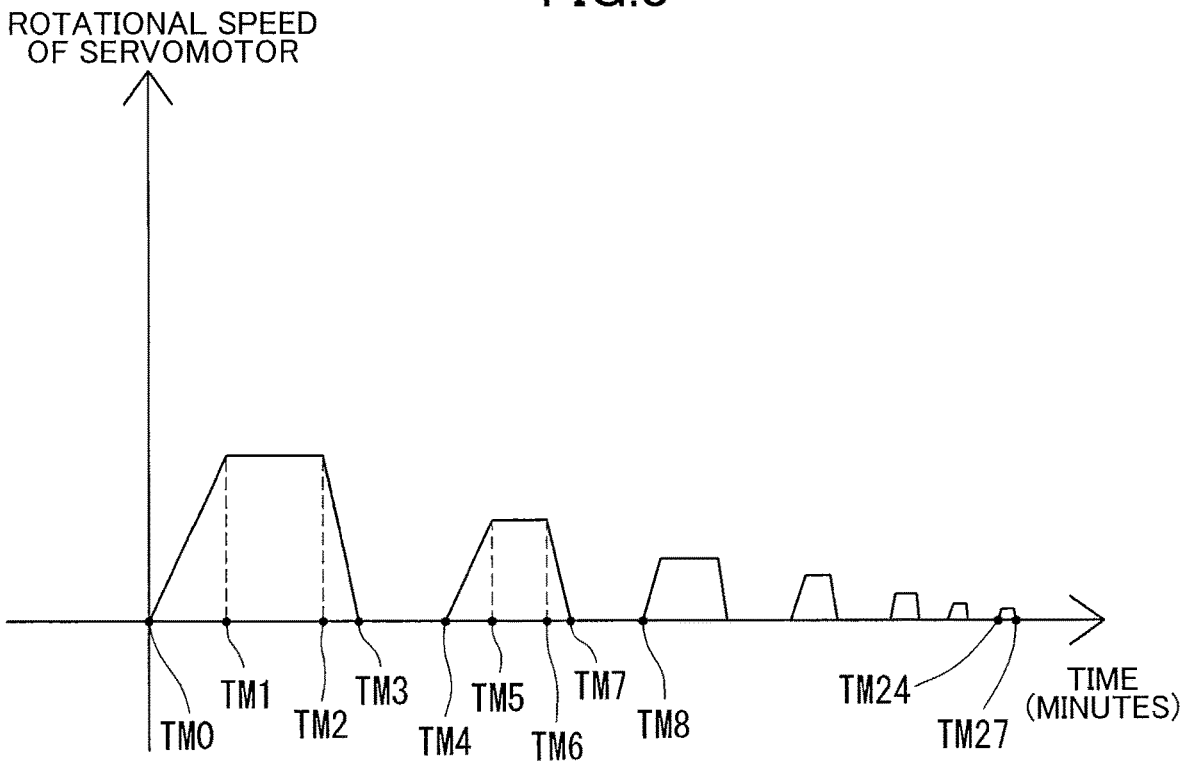
FIG. 8 is an explanatory diagram illustrating a relationship between a rotational speed of a servomotor and an elapsed time, in the single facer according to the first embodiment.

With reference to FIG. 8, the gap adjustment control according to the adjustment control routine will be described. The gap adjustment controls to be performed by the glue-roll gap adjusting motor control device 352 and the press-roll gap adjusting motor control device 353 are approximate the same. Thus, only the gap adjustment control to be performed by the press-roll gap adjusting motor control device 353 will be described below, as a representative example. FIG. 8 illustrates a relationship between a rotational speed of the servomotor 220 and an elapsed time (second).

Upon operation of the order start button 341 by an operator, the lower-level management device 310 reads the hydraulic pressure value for the glue roll 30 and the hydraulic pressure value for the press roll 44, from the program memory 320, and sends the read hydraulic pressure values as the control instruction information to the glue-application cylinder control device 350 and the press cylinder control device 351, respectively. Thus, the glue-application cylinder control device 350 controls a hydraulic pressure of each of the hydraulic cylinders 32, 33 according to the hydraulic pressure value for the glue roll 30. The press cylinder control device 351 controls a hydraulic pressure of each of the hydraulic cylinders 47, 48 according to the hydraulic pressure value for the press roll 44. During a time period where a specific order is implemented, the hydraulic pressure of each of the hydraulic cylinders 32, 33 is controlled to be maintained at a constant value, and the hydraulic pressure of each of the hydraulic cylinders 47, 48 is also controlled to be maintained at a constant value.

Every time the timing instruction is received from the lower-level management device 310, the press-roll gap adjusting motor control device 353 performs the press-roll gap adjustment control according to the adjustment control routine. When receiving the timing instruction from the lower-level management device 310, the press-roll gap adjusting motor control device 353 also receives, from the lower-level management device 310, control instruction information about the given press-roll vibration threshold value, the press-roll gap adjustment value, the first and second torque values for adjusting a press-roll gap, etc.

First of all, according to the adjustment control routine, the press-roll gap adjusting motor control device 353 operates to rotationally drive the servomotor 220 with a drive current corresponding to the first torque value, until the third wedge-shaped body 217 of the leveling block 215 illustrated in FIG. 4 comes into contact with the wall portion 216C of the casing 216. When the third wedge-shaped body 217 comes into contact with the wall portion 216C of the casing 216, generation of the detection pulses from the encoder EC21 is stopped. Then, the press-roll gap adjusting motor control device 353 recognizes the contact of the third wedge-shaped body 217 with the wall portion 216C, based on the stop of the generation of the detection pulses, and operates to stop of a supply of the drive current to the servomotor 220. In the state in which the third wedge-shaped body 217 is in contact with the wall portion 216C, the head of the adjusting screw 221 is spaced apart from the contact member 212 of the coupling block 211. In the state in which the head of the adjusting screw 221 is spaced apart from the contact member 212, the hydraulic pressure of the hydraulic cylinder 47 fully acts to press the press roll 44 against the corrugating roll 23. The press-roll gap adjusting motor control device 353 also controls drive of the servomotor 240 in the same manner as that for the servomotor 220, to cause a wedge-shaped body of the leveling block 235 to come into contact with a wall portion of a casing. Thus, the hydraulic pressure of the hydraulic cylinder 48 fully acts to press the press roll 44 against the corrugating roll 23.

Then, according to the adjustment control routine, the press-roll gap adjusting motor control device 353 operates to rotationally drive the servomotor 220 with the drive current corresponding to the first torque value, until the head of the adjusting screw 221 of the fourth wedge-shaped body 218 of the leveling block 215 illustrated in FIG. 4 comes into contact with the contact member 212 of the coupling block 211. During a time period where the head of the adjusting screw 221 is moved toward the contact member 212, the press roll 44 vibrates due to periodic contact with the ridges of the fluted portion of the upper corrugating roll 23. The vibration of the press roll 44 is transmitted to the contact member 212 of the coupling block 211 via the swingable frame 40 and the arm portion 45. That is, the adjusting screw 221 is moved toward the contact member 212 being vibrating. The first torque value is a value of rotation torque of the servomotor 220 set such that it fails to overcome a force by which the contact member 212 can press the adjusting screw 221 according to the hydraulic pressure of the press hydraulic cylinder 47, and therefore rotation of the servomotor 220 is stopped when the adjusting screw 221 comes into contact with the contact member 212.

In FIG. 8, time point TM0 indicates a time point when the drive of the servomotor 220 is started to move the head of the adjusting screw 221 toward the contact member 212. After the time point TM0, the rotational speed of the servomotor 220 is increased. At time point TM1 when the head of the adjusting screw 221 starts to come into contact with the contact member 212 being vibrating, the increase of the rotational speed of the servomotor 220 is stopped. When a pressing force of the contact member 212 applied to the head of the adjusting screw 221 becomes larger, the rotational speed of the servomotor 220 is reduced after time point TM2. Subsequently, at time point TM3, the rotation of the servomotor 220 is stopped. The press-roll gap adjusting motor control device 353 recognizes the rotational speed of the servomotor 220, based on a frequency of the detection pulses from the encoder EC21, and recognizes stop of the rotation of the servomotor 220, based on stop of the generation of the detection pulses. Even after the rotation of the servomotor 220 is stopped at the time point TM3, the press-roll gap adjusting motor control device 353 operates to continue to supply the drive current corresponding to the first torque value, to the servomotor 220.

At the time point TM3 when the rotation of the servomotor 220 is stopped, the head of the adjusting screw 221 is moved to a position where it periodically comes into contact with the contact member 212, and stopped at the position. Even when the head of the adjusting screw 221 receives a large pressing force from the contact member 212, a position of the head of the adjusting screw 221 at a time when it is stopped is held by a function of the leveling block 215, so that the servomotor 220 is kept from being reversely rotated.

When the contact member 212 being vibrating is temporarily moved away from the head of the adjusting screw 221, the servomotor 220 starts to rotate again after time point TM4. After the time point TM4, the rotational speed of the servomotor 220 is increased. At time point TM5 when the head of the adjusting screw 221 starts to come into contact with the contact member 212 being vibrating, the increase of the rotational speed of the servomotor 220 is stopped. When the pressing force of the contact member 212 applied to the head of the adjusting screw 221 becomes larger again, the rotational speed of the servomotor 220 is reduced after time point TM6. Subsequently, at time point TM7, the rotation of the servomotor 220 is stopped. In a time period from the time point TM0 to the time point TM3, the head of the adjusting screw 221 is moved toward the contact member 212, so that a downward movement (in FIG. 4) of the contact member 212 is restrained by the adjusting screw 221, and therefore the vibration amplitude of the contact member 212 is restricted. Thus, the rotational speed of the servomotor 220 at the time point TM5 becomes less than the rotational speed of the servomotor 220 at the time point TM1.

As the adjusting screw 221 is moved upwardly (in FIG. 4) according to the rotation of the servomotor 220, the vibration amplitude of the contact member 212 is gradually restricted to a smaller value. The press-roll gap adjusting motor control device 353 determines whether or not a maximum rotational speed in a time period where the servomotor 220 is rotated is reduced to a given rotational speed. For example, it is determined whether or not a maximum rotational speed reaching at the time point TM5 in a time period from the time point TM4 to the time point TM7 is reduced to a given rotational speed. The given rotational speed is determined based on the given press-roll vibration threshold value sent from the lower-level management device 310 as the control instruction information. The press-roll vibration threshold value represents a given value which is a magnitude of vibration in a state in which the vibration of the press roll 44 is approximately suppressed. The given rotational speed is a maximum rotational speed of the servomotor 220 when the servomotor 220 is driven with the drive current corresponding to the first torque value in the situation where the magnitude of vibration of the press roll 44 is equal to the press-roll vibration threshold value, and measured preliminarily and experimentally. The given rotational speed is stored in the internal memory of the press-roll gap adjusting motor control device 353 in the form of a table, in correlated relation with the type of servomotor and the press-roll vibration threshold value.

For example, when a maximum rotational speed of the servomotor 220 in a time period from time point TM24 to time point TM27 is reduced to the given rotational speed, the press-roll gap adjusting motor control device 353 stores, in an internal temporary memory thereof, a rotation amount by which the servomotor 220 is rotated in a time period from the time point TM0 to the time point TM27, as a reference rotation amount, in correlated relation with an internal temperature of the single facer 1 at the time point TM0. A position of the head of the adjusting screw 221 at the time point TM27 is set as a reference position for adjusting a gap between a right end portion of the press roll 44 illustrated in FIG. 2 and the upper corrugating roll 23. When the reference rotation amount stored this time is different from a reference rotation amount stored last time, by a given amount or more, there is a possibility that abnormality occurs, for example, in the contact between the contact member and the adjusting screw. Thus, in such a situation, an error message may be indicated or displayed.

After the adjusting screw 221 is set at the reference position, the press-roll gap adjusting motor control device 353 operates to rotationally drive the servomotor 220 with a drive current corresponding to the second torque value so as to allow the gap between the press roll 44 and the upper corrugating roll 23 to be increased from a reference gap between the two rolls 44, 23 at a time when the adjusting screw 221 is located at the reference position, by the press-roll gap adjustment value. The second torque value is a value of rotation torque of the servomotor 220 set such that it overcomes the force by which the contact member 212 can press the adjusting screw 221 according to the hydraulic pressure of the press hydraulic cylinder 47, and therefore the adjusting screw 221 can move the contact member 212. The press-roll gap adjustment value is a value obtained by subtracting a total thickness of the corrugated medium 10 and the linerboard 11 at a time when the corrugated medium 10 and the linerboard 11 are compressed by a compression force corresponding to a pressing force applied from the contact member 212 to the adjusting screw 221 when the adjusting screw 221 is located at the reference position, from a total thickness of the corrugated medium 10 and the linerboard 11 in an uncompressed state, and set experimentally.

When rotationally driving the servomotor 220 by a rotation amount corresponding to the press-roll gap adjustment value, the press-roll gap adjusting motor control device 353 operates to stop the rotation of the servomotor 220. In this case, the adjusting screw 221 moves the contact member 212 upwardly (in FIG. 4) from the reference position by an amount corresponding to the press-roll gap adjustment value. Thus, the swingable frame 40 is slightly rotated about the pivot shaft 41 in a clockwise direction, and positioned, so that the right end portion of the press roll 44 is positioned with respect to the upper corrugating roll 23, with a gap increased from the reference position by the press-roll gap adjustment value, therebetween.

The press-roll gap adjusting motor control device 353 also performs control of the servomotor 240 in a parallel way, in the same manner as that for the servomotor 220. Thus, a head of the adjusting screw of the leveling block 235 is set at a reference position for adjusting a gap between a left end portion (in FIG. 2) of the press roll 44 and the upper corrugating roll 23. Subsequently, the swingable frame 42 is slightly rotated about the pivot shaft 43, and positioned, so that the left end portion of the press roll 44 is positioned with respect to the upper corrugating roll 23, with a gap increased from the reference position by the press-roll gap adjustment value, therebetween.

As with the press-roll gap adjusting motor control device 353, the glue-roll gap adjusting motor control device 352 receives, from the lower-level management device 310, control instruction information about the given glue-roll vibration threshold value, the glue-roll gap adjustment value, the first and second torque values for adjusting a glue-roll gap, etc., and performs control of the servomotors 120, 140. Thus, each of the heads of the adjusting screws of the leveling blocks 115, 135 are set at a reference position for adjusting a gap between a respective one of right and left end portions of the glue roll 30 illustrated in FIG. 2 and the upper corrugating roll 23. Subsequently, the support plate portions 27, 28 are slightly moved and then positioned, so that each of the right and left end portions of the glue roll 30 is also positioned with respect to the upper corrugating roll 23, with a gap equivalent to the glue-roll gap adjustment value, therebetween. The glue-roll gap adjustment value is a value obtained by subtracting a thickness of the corrugated medium 10 at a time when the corrugated medium 10 is compressed by a compression force corresponding to a pressing force applied from the contact member 112 to the adjusting screw 121 when the adjusting screw 121 is located at the reference position, from a thickness of the corrugated medium 10 in an uncompressed state, and set experimentally. The glue-roll vibration threshold value represents a given value which is a magnitude of vibration in a state in which the vibration of the glue roll 30 is approximately suppressed. A given rotational speed is a maximum rotational speed of each of the servomotors 120, 140 when the servomotor is driven with a drive current corresponding to the first torque value in the situation where the magnitude of vibration of the glue roll 30 is equal to the glue-roll vibration threshold value, and measured preliminarily and experimentally. The given rotational speed for each of the servomotors 120, 140 is stored in the internal memory of the glue-roll gap adjusting motor control device 352 in the form of a table, in correlated relation with the type of servomotor and the glue-roll vibration threshold value.

<<Effects of Single Facer According to First Embodiment>>

In the first embodiment, the encoder EC21 for detecting the rotation of the servomotor 220 is used to detect the magnitude of the vibration occurring in the press roll 44, so that it is not necessary to provide a special vibration detection device in the vicinity of the press roll 44. Further, the encoder EC 11 for detecting the rotation of the servomotor 120 is used to detect the magnitude of the vibration occurring in the glue roll 30, so that it is not necessary to provide a special vibration detection device in the vicinity of the glue roll 30. Generally, such a special vibration detection device is likely to confront a problem of difficulty in accurately detecting the magnitude of the vibration of the processing roll (press or glue roll), because it is exposed to high temperatures and floating dust inside the single facer 1. In contrast, the utilization of the encoder of the servomotor makes it possible to accurately detect the vibration of the processing roll.

In the first embodiment, the press roll 44 is supported by the pair of swingable frames 40, 42 at right and left ends thereof, independently. Thus, a gap between the left end portion of the press roll 44 and the upper corrugating roll 23 is likely to become different from a gap between the right end portion of the press roll 44 and the upper corrugating roll 23. For this reason, in the first embodiment, the gap adjustment control is configured to control the two servomotors 220, 240 to allow the gap between the left end portion of the press roll 44 and the upper corrugating roll 23 to become equal to the gap between the right end portion of the press roll 44 and the upper corrugating roll 23. This makes it possible to set an even gap over the entire region of the press roll 44 in its rotational axis direction. The gap adjustment control is also configured to control the two servomotors 120, 140 to allow the gap between the left end portion of the glue roll 30 and the upper corrugating roll 23 to become equal to the gap between the right end portion of the glue roll 30 and the upper corrugating roll 23. This makes it possible to set an even gap over the entire region of the glue roll 30 in its rotational axis direction.

In the first embodiment, the lower-level management device 310 is configured to generate the timing instruction for a start of the gap adjustment routine, when the internal temperature change amount in the single facer 1 becomes equal to the given temperature change amount, wherein, in a starting stage of implementation of an order, the timing instruction is generated at relatively short time intervals to thereby perform the gap adjustment control with relatively high frequency. Thus, even in a situation where thermal strain occurs in components of the single facer 1 due to a rapid change of the internal temperature of the single facer 1, it becomes possible to maintain the gap between the processing roll (e.g., the press roll 44) and the upper corrugating roll 23 at a given gap.

In the first embodiment, as illustrated in FIG. 1, the distance D1 between the contact member 212 and the axis of the pivot shaft 41 is set to be greater than the distance D2 between the rotation center of the press roll 44 and the axis of the pivot shaft 41. Thus, when the press roll 44 vibrates, vibration of the contact member 212 becomes greater than vibration of the rotation center of the press roll 44, so that it becomes possible to accurately detect a change in magnitude of the vibration of the contact member 212, in the form of a change in rotational speed of the servo motor 220. In addition, as compared to a configuration in which the contact member 212 comes into contact with the adjusting screw 221 at a position closer to the pivot shaft 41 of the press roll 44 (swingable frame 40), it becomes possible to finely adjust the gap between the press roll 44 and the upper corrugating roll 23, even when the adjusting screw 221 is moved by the same distance.

Second Embodiment

With reference to the drawings, a single facer 1 according to a second embodiment of the present invention will be described. In the first embodiment, each of the control devices, for example, the press-roll gap adjusting motor control device 353, is configured to, based on the detection pulses from the encoder EC21, determine whether or not the maximum rotational speed of the servomotor 220 is reduced to the given rotational speed. The second embodiment is different from the first embodiment in that the single facer according to the second embodiment is configured to determine whether or not the maximum rotational speed of the servomotor is reduced to a given rotational speed, based on an elapse of a given control time period after the rotation of the servomotor is first stopped, without using a detection device such as an encoder. Thus, only this difference will be described below. In the second embodiment, the same element or component as that in the first embodiment is assigned with the same reference numeral or sign, and its detailed description will be appropriately omitted.

<<Electrical Configuration>>

Figure 9:
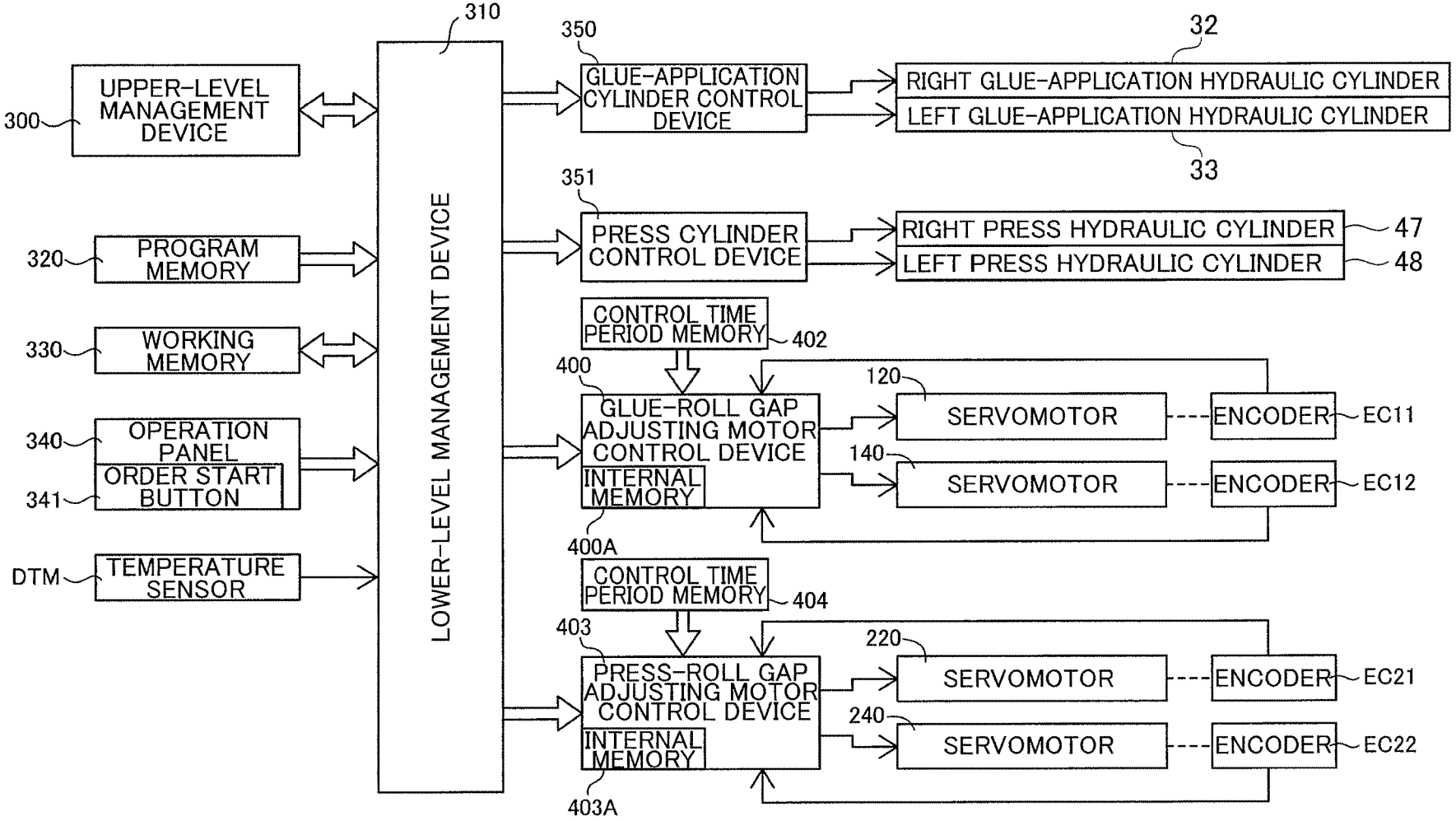
FIG. 9 is a block diagram illustrating an electrical configuration of a single facer according to a second embodiment of the present invention.

A mechanical configuration of the single facer 1 according to the second embodiment is the same as that in the first embodiment. Thus, only an electrical configuration of the single facer 1 according to the second embodiment will be described with reference to FIG. 9. In particular, the second embodiment is different from the first embodiment in terms of configurations of a glue-roll gap adjusting motor control device 400 and a press-roll gap adjusting motor control device 403. Thus, the following description will be made with a focus on the configurations of the two control devices. FIG. 9 is a block diagram illustrating the electrical configuration of the single facer 1 according to the second embodiment.

In FIG. 9, the glue-roll gap adjusting motor control device 400 is connected to a lower-level management device 310, and configured to control a rotation direction and a drive current of two servomotors 120, 140, according control instruction information from the lower-level management device 310. Specifically, the glue-roll gap adjusting motor control device 400 is configured to receive control instruction information such as a glue-roll gap adjustment value, and first and second torque values for adjusting a glue-roll gap, from the lower-level management device 310. The glue-roll gap adjusting motor control device 400 is configured to control the rotation direction and the drive current of each of the servomotors 120, 140, based on the received control instruction information, and a control time period from a control time period memory 402. A gap between a glue roll 30 and an upper corrugating roll 23 is instructed by the glue-roll gap adjustment value from the lower-level management device 310. The glue-roll gap adjusting motor control device 400 fixedly stores in an internal memory 400A an adjustment control routine to perform glue-roll gap adjustment control, wherein it is configured to execute the adjustment control routine according to a timing instruction from the lower-level management device 310. The glue-roll gap adjusting motor control device 352 is composed of a computer comprising the internal memory 400A.

In the second embodiment, an elapsed time from a time when rotation of each of the servomotors is first stopped after the servomotor is rotationally driven with a drive current corresponding to the first torque value so as to move an adjusting screw of each leveling block toward a contact member, as described later, in a state in which the glue roll 30 is fully pressed against the upper corrugating roll 23 by hydraulic cylinders 32, 33, while interposing a corrugated medium 10 therebetween, to a time when a maximum rotational speed of each of the servomotors is reduced to a given rotational speed corresponding to the given glue-roll vibration threshold value in the first embodiment is measured preliminarily and experimentally. The measured elapsed time varies depending on a type of paperboard for the corrugated medium 10, i.e., a raw material, a thickness, etc., of a paperboard for the corrugated medium 10. Thus, the control time period memory 402 fixedly stores therein the preliminarily measured elapsed time, as a control time period, in correlated relation with the type of paperboard for the corrugated medium 10.

The press-roll gap adjusting motor control device 403 is connected to the lower-level management device 310, and configured to control a rotation direction and a drive current of two servomotors 220, 240, according control instruction information from the lower-level management device 310. Specifically, the press-roll gap adjusting motor control device 403 is configured to receive control instruction information such as a press-roll gap adjustment value, and first and second torque values for adjusting a press-roll gap, from the lower-level management device 310. The press-roll gap adjusting motor control device 403 is configured to control the rotation direction and the drive current of each of the servomotors 220, 240, based on the received control instruction information, and a control time period from a control time period memory 404. A gap between a press roll 44 and the upper corrugating roll 23 is instructed by the press-roll gap adjustment value from the lower-level management device 310. The glue-roll gap adjusting motor control device 403 fixedly stores in an internal memory 403A an adjustment control routine to perform press-roll gap adjustment control, wherein it is configured to execute the adjustment control routine according to the timing instruction from the lower-level management device 310. The press-roll gap adjusting motor control device 403 is composed of a computer comprising the internal memory 403A.

In the second embodiment, an elapsed time from a time when rotation of each of the servomotors is first stopped after the servomotor is rotationally driven with a drive current corresponding to the first torque value so as to move an adjusting screw of a leveling block toward a contact member as described later, in a state in which the press roll 44 is fully pressed against the upper corrugating roll 23 by hydraulic cylinders 47, 48, while interposing the corrugated medium 10 and a linerboard 11 therebetween, to a time when a maximum rotational speed of each of the servomotors is reduced to a given rotational speed corresponding to the given press-roll vibration threshold value in the first embodiment is measured preliminarily and experimentally. The measured elapsed time varies depending on a type of paperboard for each of the corrugated medium 10 and the linerboard 11, i.e., a raw material, a thickness, etc., of a paperboard for each of the corrugated medium 10 and the linerboard 11. Thus, the control time period memory 404 fixedly stores therein the preliminarily measured elapsed time, as a control time period, in correlated relation with the type of paperboard for each of the corrugated medium 10 and the linerboard 11.

<<Operation and Functions of Single Facer According to Second Embodiment>>

An operation and functions of the single facer 1 according to the second embodiment will be described below. In the second embodiment, any operation and function other than those of the gap adjustment control according to the adjustment control routine are the same as those in the first embodiment. Thus, only the gap adjustment control will be described below.

<Gap Adjustment Control according to Adjustment Control Routine>

Figure 10:
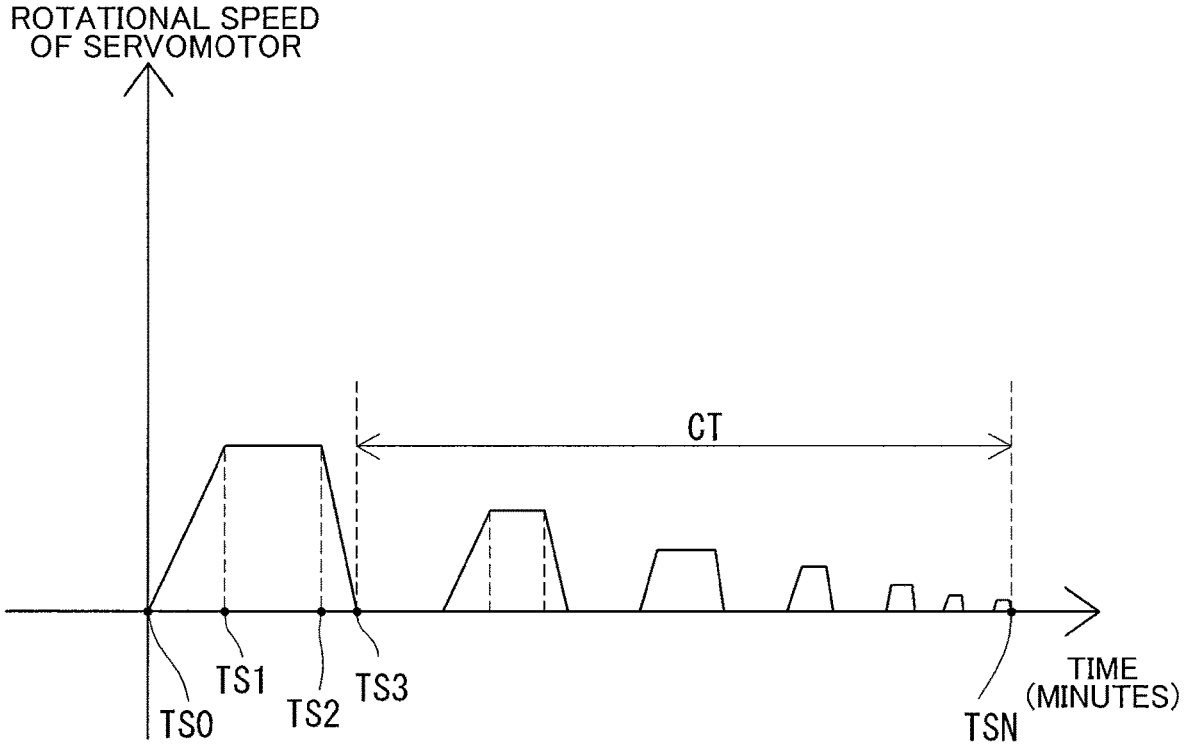
FIG. 10 is an explanatory diagram illustrating a relationship between a rotational speed of a servomotor and an elapsed time, in the single facer according to the second embodiment.

With reference to FIG. 10, the gap adjustment control according to the adjustment control routine will be described. The gap adjustment controls to be performed by the glue-roll gap adjusting motor control device 400 and the press-roll gap adjusting motor control device 403 are approximate the same. Thus, only the gap adjustment control to be performed by the press-roll gap adjusting motor control device 403 will be described below, as a representative example. FIG. 10 illustrates a relationship between a rotational speed of the servomotor 220 and an elapsed time (second).

Every time the timing instruction is received from the lower-level management device 310, the press-roll gap adjusting motor control device 403 performs the press-roll gap adjustment control according to the adjustment control routine. When receiving the timing instruction from the lower-level management device 310, the press-roll gap adjusting motor control device 403 also receives, from the lower-level management device 310, control instruction information about the press-roll gap adjustment value, the first and second torque values for adjusting a press-roll gap, etc.

First of all, according to the adjustment control routine, the press-roll gap adjusting motor control device 403 operates to rotationally drive the servomotor 220 with a drive current corresponding to the first torque value, until a third wedge-shaped body 217 of a leveling block 215 comes into contact with a wall portion 216C of a casing 216, as illustrated in FIG. 4. When the third wedge-shaped body 217 comes into contact with the wall portion 216C of the casing 216, generation of detection pulses from an encoder EC21 is stopped. Then, the press-roll gap adjusting motor control device 403 recognizes the contact of the third wedge-shaped body 217 with the wall portion 216C, based on the stop of the generation of the detection pulses, and operates to stop of a supply of the drive current to the servomotor 220. In the state in which the third wedge-shaped body 217 is in contact with the wall portion 216C, a head of an adjusting screw 221 of a fourth wedge-shaped body 218 of the leveling block 215 illustrated in FIG. 4 is spaced apart from a contact member 212 of a coupling block 211. In the state in which the head of the adjusting screw 221 is spaced apart from the contact member 212, a hydraulic pressure of the hydraulic cylinder 47 fully acts to press the press roll 44 against the corrugating roll 23. The press-roll gap adjusting motor control device 403 also controls drive of the servomotor 240 in the same manner as that for the servomotor 220, to cause a wedge-shaped body of a leveling block 235 to come into contact with a wall portion of a casing. Thus, the hydraulic pressure of the hydraulic cylinder 48 fully acts to press the press roll 44 against the corrugating roll 23.

Then, according to the adjustment control routine, the press-roll gap adjusting motor control device 403 operates to rotationally drive the servomotor 220 with the drive current corresponding to the first torque value, until the head of the adjusting screw 221 comes into contact with the contact member 212 of the coupling block 211. During a time period where the head of the adjusting screw 221 is moved toward the contact member 212, the press roll 44 vibrates due to periodic contact with ridges of a fluted portion of the upper corrugating roll 23, and the vibration of the press roll 44 is transmitted to the contact member 212 of the coupling block 211 via a swingable frame 40 and an arm portion 45. The first torque value is a value of rotation torque of the servomotor 220 set in the same manner as that for the first torque in the first embodiment.

In FIG. 10, time point TS0 indicates a time point when the drive of the servomotor 220 is started to move the head of the adjusting screw 221 toward the contact member 212. After the time point TS0, the rotational speed of the servomotor 220 is increased. At time point TS 1 when the head of the adjusting screw 221 starts to come into contact with the contact member 212 being vibrating, the increase of the rotational speed of the servomotor 220 is stopped. When a pressing force of the contact member 212 applied to the head of the adjusting screw 221 becomes larger, the rotational speed of the servomotor 220 is reduced after time point TS2. Subsequently, at time point TS3, the rotation of the servomotor 220 is stopped. The press-roll gap adjusting motor control device 403 recognizes the rotational speed of the servomotor 220, based on a frequency of the detection pulses from the encoder EC21, and recognizes stop of the rotation of the servomotor 220, based on stop of the generation of the detection pulses. When recognizing that the rotation of the servomotor 220 is stopped at the time point TS3, the press-roll gap adjusting motor control device 403 reads, from the control time period memory 404, a control time period CT correlated with a type of paperboard for each of the corrugated medium 10 and the linerboard to be used for an order, such as a thickness of a paperboard. Then, the press-roll gap adjusting motor control device 403 operates to continue to supply the drive current corresponding to the first torque value during the read control time period.

As a result of supplying the drive current to the servomotor 220 during the control time period, the adjusting screw 221 is moved upwardly (in FIG. 4), and, along with the movement, a vibration amplitude of the contact member 212 is gradually restricted to a small value. When the control time period CT has elapsed, the press-roll gap adjusting motor control device 403 operates to stop the supply of the drive current corresponding to the first torque value to the servomotor 220.

When the control time period CT has elapsed at time point TSN illustrated in FIG. 10, the press-roll gap adjusting motor control device 403 operates to store, in an internal temporary memory thereof, a rotation amount by which the servomotor 220 is rotated in a time period from the time point TS0 to the time point TSN, as a reference rotation amount, in correlated relation with an internal temperature of the single facer 1 at the time point TS0. A position of the head of the adjusting screw 221 at the time point TSN is set as a reference position for adjusting a gap between a right end portion of the press roll 44 illustrated in FIG. 2 and the upper corrugating roll 23.

After the adjusting screw 221 is set at the reference position, the press-roll gap adjusting motor control device 403 operates to rotationally drive the servomotor 220 with a drive current corresponding to the second torque value so as to allow the gap between the press roll 44 and the upper corrugating roll 23 to be increased from a reference gap between the two rolls 44, 23 at a time when the adjusting screw 221 is located at the reference position, by the press-roll gap adjustment value. The second torque value is a value of rotation torque of the servomotor 220 set in the same manner as that for the second torque value in the first embodiment. The press-roll gap adjustment value is experimentally set in the same manner as that for the press-roll gap adjustment value in the first embodiment.

When rotationally driving the servomotor 220 by a rotation amount corresponding to the press-roll gap adjustment value, the press-roll gap adjusting motor control device 403 operates to stop the rotation of the servomotor 220. In this case, the adjusting screw 221 moves the contact member 212 upwardly (in FIG. 4) from the reference position by an amount corresponding to the press-roll gap adjustment value. Thus, the swingable frame 40 is slightly rotated about a pivot shaft 41 in a clockwise direction, and positioned, so that the right end portion of the press roll 44 is positioned with respect to the upper corrugating roll 23, with a gap equivalent to the press-roll gap adjustment value, therebetween.

The press-roll gap adjusting motor control device 403 also performs control of the servomotor 240 in a parallel way, in the same manner as that for the servomotor 220. Thus, a head of an adjusting screw of the leveling block 235 is set at a reference position for adjusting a gap between a left end portion (in FIG. 2) of the press roll 44 and the upper corrugating roll 23. Subsequently, a swingable frame 42 is slightly rotated about a pivot shaft 43, and positioned, so that the left end portion of the press roll 44 is positioned with respect to the upper corrugating roll 23, with a gap equivalent to the press-roll gap adjustment value, therebetween.

As with the press-roll gap adjusting motor control device 403, the glue-roll gap adjusting motor control device 400 receives, from the lower-level management device 310, control instruction information about the glue-roll gap adjustment value, the first and second torque values for adjusting a glue-roll gap, etc., and performs control of the servomotors 120, 140. Thus, each of the heads of the adjusting screws of the leveling blocks 115, 135 are set at a reference position for adjusting a gap between a respective one of right and left end portions of the glue roll 30 illustrated in FIG. 2 and the upper corrugating roll 23. Subsequently, support plate portions 27, 28 are slightly moved and then positioned, so that each of the right and left end portions of the glue roll 30 is also positioned with respect to the upper corrugating roll 23, with a gap equivalent to the glue-roll gap adjustment value, therebetween. The glue-roll vibration threshold value is experimentally set in the same manner as that for the glue-roll vibration threshold value in the first embodiment.

<<Effects of Single Facer According to Second Embodiment>>

In the second embodiment, whether or not the maximum rotational speed of the servomotor 220 is reduced to the given rotational speed is determined based on an elapse of the control time period CT after the time point TS3 when the rotation of the servomotor 220 is first stopped, without using a detection device such as an encoder. Thus, there is no need for a processing of detecting the rotational speed of the servomotor 220 in the time period from the time point TS3 to the time point TSN. This makes it easier to set the head of the adjusting screw of each of the leveling blocks at the reference position for adjusting the gap between each of the right and left end portions of the press roll 44 and the upper corrugating roll 23.

Third Embodiment

With reference to the drawings, a single facer 1 according to a second embodiment of the present invention will be described. In the first embodiment, each of the control devices, for example, the press-roll gap adjusting motor control device 353, is configured to, based on the detection pulses from the encoder EC21, determine whether or not the maximum rotational speed of the servomotor 220 is reduced to the given rotational speed, to thereby set the head of the adjusting screw of each of the leveling blocks at the reference position for gap adjustment. The third embodiment is different from the first embodiment in that the single facer according to the third embodiment is configured to detect rotation torque of a servomotor, and determine whether or not a state in which the rotation torque reaches a given limit torque has continued for a given time, to thereby set a head of an adjusting screw of each leveling block at a reference position for gap adjustment, as described later, and a press roll 44 in the third embodiment is made of a non-metal material. Thus, only these differences will be described below. In the third embodiment, the same element or component as that in the first embodiment is assigned with the same reference numeral or sign, and its detailed description will be appropriately omitted.

In the third embodiment, upper and lower corrugating rolls 23, 24 and a glue roll 30 are the same as those in the first and second embodiments. However, a press roll 44 in the third embodiment is made of an elastically deformable non-metal material such as an aramid fiber material.

<<Electrical Configuration>>

Figure 11:
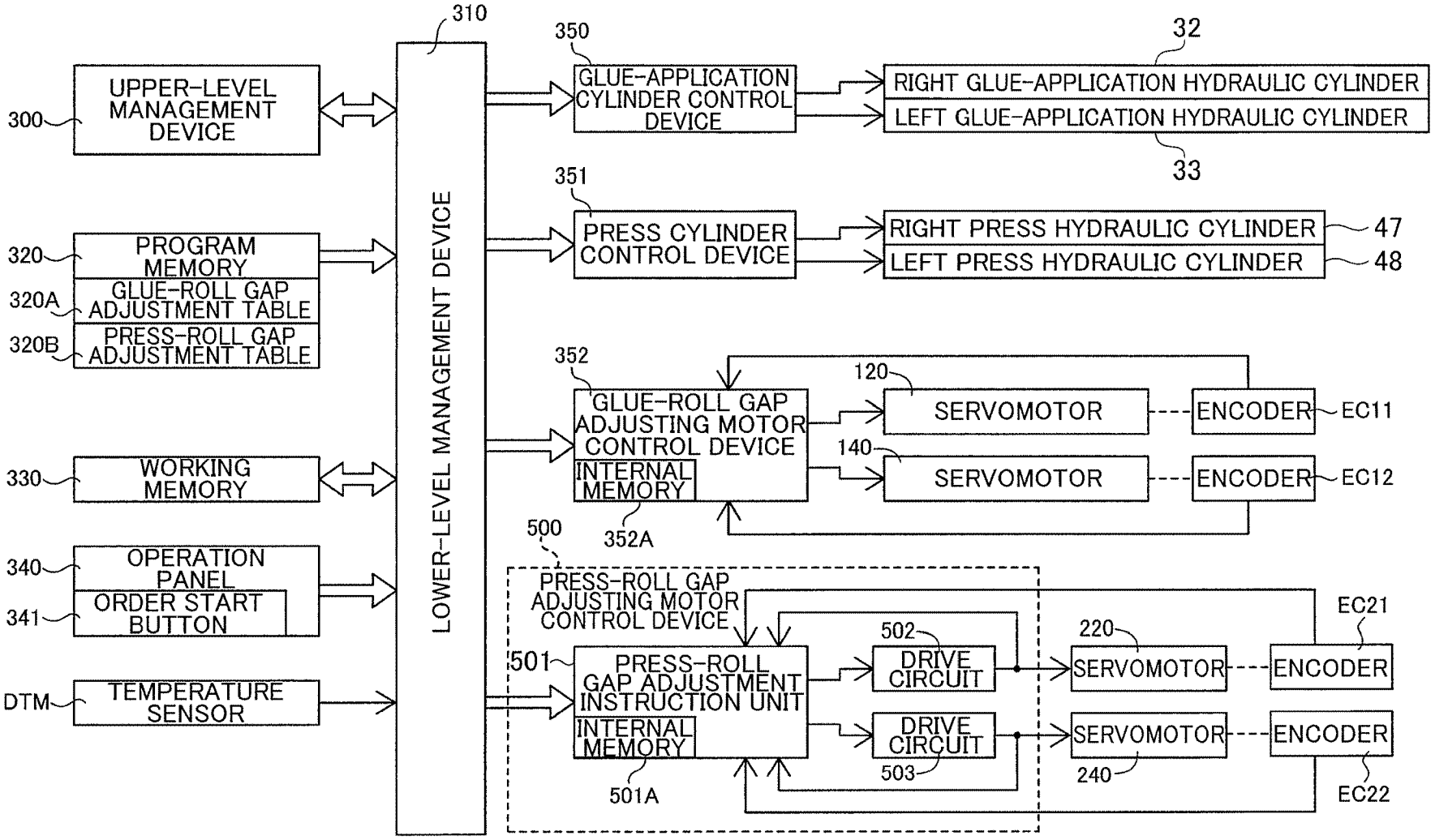
FIG. 11 is a block diagram illustrating an electrical configuration of a single facer according to a third embodiment of the present invention.
Figures 12, 13:
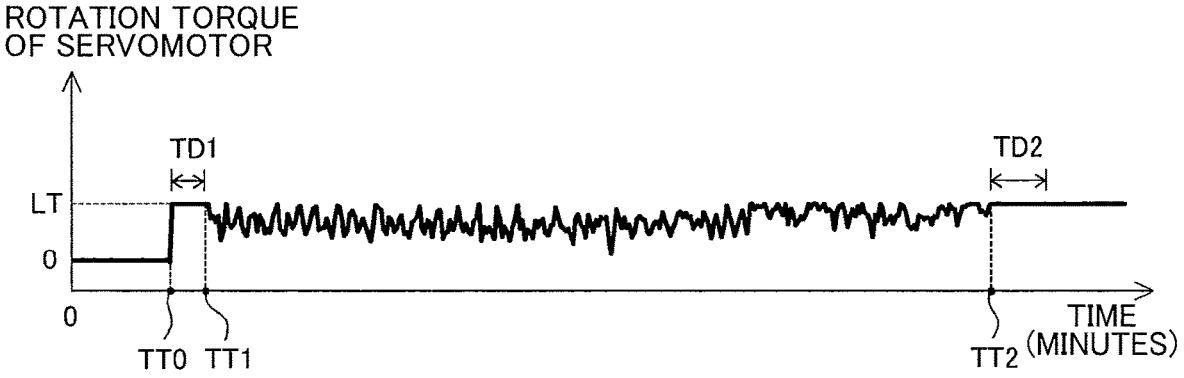
FIG. 12 is an explanatory diagram illustrating a stored content of a press-roll gap adjustment table, in the single facer according to the third embodiment.
FIG. 13 is an explanatory diagram illustrating a relationship between a rotation torque of a servomotor and an elapsed time, in the single facer according to the third embodiment.

With reference to FIGS. 11 and 12, an electrical configuration of the single facer 1 according to the third embodiment will be described. In particular, the third embodiment is different from the first embodiment in terms of a stored content of a program memory 320 and a configuration of a press-roll gap adjusting motor control device 500. Thus, the following description will be made with a focus on these differences. FIG. 11 is a block diagram illustrating the electrical configuration of the single facer 1 according to the third embodiment. FIG. 12 is an explanatory diagram illustrating a stored content of a press-roll gap adjustment table 320B.

The program memory 320 fixedly stores therein programs such as a main control routine of the single facer 1, an adjustment instruction routine for determining a timing of generating an instruction for a start of gap adjustment control, and fixedly stores therein various preset values. For example, as preset values for the glue roll 30, the program memory 320 stores therein a hydraulic pressure value for the glue roll 30, a given glue-roll vibration threshold value, a glue-roll gap adjustment value, and first and second torque values for adjusting a glue-roll gap, in correlated relation with a type of paperboard, such as a raw material, a thickness, a basis weight, etc., of a paperboard, in the same manner as that in the first embodiment. Further, as preset values for the press roll 44, the program memory 320 stores therein a hydraulic pressure value for the press roll 44, a given limit torque value, a given duration, and a press-roll gap adjustment value, in correlated relation with a type of paperboard, such as a raw material, a thickness, a basis weight, etc., of a paperboard. The given limit torque value is set to a torque value which fails to overcome a force by which a contact member 212 of a coupling block 211 can press an adjusting screw 221 of a fourth wedge-shaped body 218 of a leveling block 215, according to a hydraulic pressure of a press hydraulic cylinder 47. In the second embodiment, the given limit torque value is set to a value equivalent to 30% of a rated torque value of each of two servomotors 220, 240. In FIG. 13, the given limit torque value is indicated by the rotation torque LT. The given duration is a time period in which a rotation torque of each of the servomotors 220, 240 is maintained at the given limit torque. In FIG. 3, the given duration is indicated by the time period TD2. A lower-level management device 310 is configured to, among the control instruction information sent from an upper-level management device 300 according to each order, read various preset values correlated with a type of paperboard from the program memory 320, and send the preset values to each control device. The program memory 320 comprises a glue-roll gap adjustment table 320A and a press-roll gap adjustment table 320B. In the third embodiment, the glue-roll gap adjustment value for the glue roll 30 is stored in the glue-roll gap adjustment table 320A, in correlated relation with a thickness of a corrugated medium 10 in the same manner as that in the first embodiment. On the other hand, the press-roll gap adjustment value for the press roll 44 is stored in the press-roll gap adjustment table 320B, in correlated relation with a combination of respective basis weights of the corrugated medium 10 and the linerboard 11. Generally, a thickness of a paperboard becomes larger along with an increase in thickness of the paperboard.

With reference to FIG. 12, the press-roll gap adjustment table 320B will be described in detail. In FIG. 12, each of the basis weight ($g/m^2$) of the corrugated medium 10 and the basis weight ($g/m^2$) is classified into five zones: "0 to 120"; "121 to 160"; "161 to 180"; "181 to 200" and "201 or more". The press-roll gap adjustment table 320B stores therein a large number of press-roll gap adjustment values D11 to D55. Each of the press-roll gap adjustment values is correlated with a combination of one of the basis weight zones of the corrugated medium 10 and one of the basis weight zones of the linerboard 11. In the third embodiment, as each of the press-roll gap adjustment values, a smaller value is set along with a decrease in basis weight. That is, the press-roll gap adjustment value D11 is set to the smallest value of 0.02 mm, and the press-roll gap adjustment value D55 is set to the largest value of 0.05 mm.

The press-roll gap adjusting motor control device 500 is connected to the lower-level management device 310, and configured to control a rotation direction and a drive current of each of the servomotors 220, 240, according the control instruction information from the lower-level management device 310. The press-roll gap adjusting motor control device 500 comprises a press-roll gap adjustment instruction unit 501, and two drive circuits 502, 503. Specifically, the press-roll gap adjustment instruction unit 501 is configured to generate an instruction for the rotation direction and the drive current of the servomotor 220, based on the control instruction information from the lower-level management device 310, detection pulses from an encoder EC21, and a drive current fed back from the drive circuit 502. A gap between the press roll 44 and the upper corrugating roll 23 is instructed by the press-roll gap adjustment value from the lower-level management device 310. Further, the press-roll gap adjustment instruction unit 501 is configured to generate an instruction for the rotation direction and the drive current of the servomotor 240, based on the control instruction information from the lower-level management device 310, detection pulses from an encoder EC22, and a drive current fed back from the drive circuit 503. The press-roll gap adjustment instruction unit 501 fixedly stores in an internal memory 501A an adjustment control routine to perform press-roll gap adjustment control, wherein it is configured to execute the adjustment control routine according to a timing instruction from the lower-level management device 310. The press-roll gap adjustment instruction unit 501 is composed of a computer comprising the internal memory 501A.

When a load applied to each of the servomotors 220, 240 becomes larger, a drive current to be supplied to the servomotor is increased to generate a rotation torque which can overcome the load. A value of the drive current supplied from the drive circuit 502 (503) to the servomotor 220 (240) is indicative of a magnitude of the rotation torque of the servomotor 220 (230). Thus, a drive current fed back from the drive circuit 502 (503) is equivalent to a torque detection signal indicative of the magnitude of the rotation torque of the servomotor 220 (240). The press-roll gap adjustment instruction unit 501 is configured to execute the adjustment control routine to thereby instruct the drive circuit 502 (503) to supply a drive current to the servomotor 220 (240) while allowing a value of the drive current to avoid exceeding a current value corresponding to the given limit torque value.

The drive circuit 502 (503) is configured to comprise a current amplifier circuit to control a direction and an amount of a drive current to be supplied to the servomotor 220 (240) according to the control instruction information about the rotation direction and the drive current from the press-roll gap adjustment instruction unit 501. A control device for controlling a rotational position, a rotational speed and a rotation torque of a servomotor as in the press-roll gap adjusting motor control device 500 is commonly known as disclosed, for example, in JP 2006-102889 A.

<<OPERATION AND FUNCTIONS OF SINGLE FACER ACCORDING TO THIRD EMBODIMENT >>

An operation and functions of the single facer 1 according to the third embodiment will be described below. In the third embodiment, any operation and function other than those of the gap adjustment control according to the adjustment control routine executed by the press-roll gap adjusting motor control device 500 are the same as those in the first embodiment. Thus, only the gap adjustment control will be described below.

<Gap Adjustment Control according to Adjustment Control Routine>

With reference to FIG. 13, the gap adjustment control according to the adjustment control routine executed by the press-roll gap adjusting motor control device 500 will be described. FIG. 13 illustrates a relationship between a rotation torque of the servomotor 220 and an elapsed time (second).

When an operator manually operates an order start button 341, a glue-application cylinder control device 350 controls a hydraulic pressure of each of two hydraulic cylinders 32, 33 according to the hydraulic pressure value for the glue roll 30, in the same manner as that in the first embodiment. Further, a press cylinder control device 351 controls a hydraulic pressure of each of two hydraulic cylinders 47, 48 according to the hydraulic pressure value for the press roll 44. During a time period where a specific order is implemented, the hydraulic pressure of each of the hydraulic cylinders 32, 33 is controlled to be maintained at a constant value, and the hydraulic pressure of each of the hydraulic cylinders 47, 48 is also controlled to be maintained at a constant value.

Every time the timing instruction is received from the lower-level management device 310, the press-roll gap adjustment instruction unit 501 performs the press-roll gap adjustment control according to the adjustment control routine. When receiving the timing instruction from the lower-level management device 310, the press-roll gap adjustment instruction unit 501 also receives, from the lower-level management device 310, the given limit torque value, the given duration, the press-roll gap adjustment value, etc.

First of all, according to the adjustment control routine, the press-roll gap adjustment instruction unit 501 operates to rotationally drive the servomotor 220 with a drive current corresponding to the given limit torque value, until a third wedge-shaped body 217 of the leveling block 215 illustrated in FIG. 4 comes into contact with a wall portion 216C of a casing 216. When the third wedge-shaped body 217 comes into contact with the wall portion 216C of the casing 216, generation of the detection pulses from the encoder EC21 is stopped. Then, the press-roll gap adjustment instruction unit 501 recognizes the contact of the third wedge-shaped body 217 with the wall portion 216C, based on the stop of the generation of the detection pulses, and operates to stop of a supply of the drive current to the servomotor 220. In the state in which the third wedge-shaped body 217 is in contact with the wall portion 216C, a head of the adjusting screw 221 is spaced apart from the contact member 212 of the coupling block 211. In the state in which the head of the adjusting screw 221 is spaced apart from the contact member 212, the hydraulic pressure of the hydraulic cylinder 47 fully acts to press the press roll 44 against the corrugating roll 23. The press-roll gap adjustment instruction unit 501 also controls drive of the servomotor 240 in the same manner as that for the servomotor 220, to cause a wedge-shaped body of a leveling block 235 to come into contact with a wall portion of a casing. Thus, the hydraulic pressure of the hydraulic cylinder 48 fully acts to press the press roll 44 against the corrugating roll 23.

Then, according to the adjustment control routine, the press-roll gap adjustment instruction unit 501 operates to rotationally drive the servomotor 220 with the drive current corresponding to the given limit torque value, until the head of the adjusting screw 221 of the fourth wedge-shaped body 218 of the leveling block 215 comes into contact with the contact member 212 of the coupling block 211. During a time period where the head of the adjusting screw 221 is moved toward the contact member 212, the press roll 44 vibrates due to periodic contact with ridges of a fluted portion of the upper corrugating roll 23. Vibration of the press roll 44 is transmitted to the contact member 212 of the coupling block 211 via a swingable frame 40 and an arm portion 45. That is, the adjusting screw 221 is moved toward the contact member 212 being vibrating.

In FIG. 13, time point TT0 indicates a time point when the drive of the servomotor 220 is started to move the head of the adjusting screw 221 toward the contact member 212. When the servomotor 220 starts rotating after the time point TT0, a rotation torque of the servomotor 220 is rapidly increased, and then restricted to the given limit torque value. In a situation where the rotation torque of the servomotor 220 is restricted to the given limit torque value, the head of the adjusting screw 221 starts to come into contact with the contact member 212 being vibrating. The time point of the start of the contact is time point TT1.

When a pressing force of the contact member 212 applied to the head of the adjusting screw 221 is reduced, the rotation torque of the servomotor 220 becomes less than the given limit torque value. On the other hand, when the pressing force of the contact member 212 applied to the head of the adjusting screw 221 is increased, the rotation torque of the servomotor 220 is increased toward the given limit torque value. Thus, the rotation torque of the servomotor 220 is repeatedly and alternately reduced from the given limit torque and increased toward the given limit torque. According to the vibration of the press roll 44 caused by rotation of the corrugating rolls 23, 24, the above rise and fall of the rotation torque will be repeated in a time period from the time point TT1 to time point TT2.

In the time period from the time point TT1 to time point TT2, when the contact member 212 being vibrating is temporarily moved away from the head of the adjusting screw 221 according to the vibration of the press roll 44, or when the pressing force of the contact member 212 applied to the head of the adjusting screw 221 is reduced, the head of the adjusting screw 221 is moved upwardly (in FIG. 4). Even when the head of the adjusting screw 221 receives a large pressing force from the contact member 212, a position of the head of the adjusting screw 221 after the movement is held by a function of the leveling block 215, so that the servomotor 220 is kept from being reversely rotated.

Along with the upward movement (in FIG. 4) of the adjusting screw 221 according to the rotation the servomotor 220, the vibration amplitude of the contact member 212 is gradually restricted to a smaller value. The press-roll gap adjustment instruction unit 501 repeatedly determines whether or not a duration of a state in which the rotation torque of the servomotor 220 is restricted to the given limit torque, after the start of the rotation of the servomotor 220 at the time point TT0, has reached a given duration TD2. Just after the start of the rotation of the servomotor 220, the rotation torque of the servomotor 220 is restricted to the given limit torque value for a time TD 1. However, in the third embodiment, the given duration TD2 is greater than the duration TD 1. The given duration TD2 is set to a value sufficiently longer than a period of vibration occurring in the corrugating rolls 23, 24, which is measured through experiment in a situation where a single-faced corrugated paperboard 12 is produced under a condition that a rotational speed of each of the corrugating rolls 23, 24 is set to the slowest value.

When the head of the contact member 212 comes into contact with the adjusting screw 221 in a state in which the vibration amplitude of the contact member 212 is restricted to a relatively small value, a relatively large pressing force is continually applied to the head of the contact member 212. Thus, a time period in which the rotation torque of the servomotor 220 is restricted to the given limit torque value is extended. When the press-roll gap adjustment instruction unit 501 determines that the time period of the restricted state reaches the given duration TD2, it instructs the drive circuit 502 to stop the supply of the drive current to the servomotor 220.

Further, after the determination on the elapse of the given duration TD2, the press-roll gap adjustment instruction unit 501 operates to store, in an internal temporary memory thereof, a rotation amount by which the servomotor 220 is rotated in a time period from the time point TT0 to the time point TT2, as a reference rotation amount, in correlated relation with an internal temperature of the single facer 1 at the time point TT0. A position of the head of the adjusting screw 221 at the time point TT2 is set as a reference position for adjusting a gap between a right end portion of the press roll 44 illustrated in FIG. 2 and the upper corrugating roll 23. When the reference rotation amount stored this time is different from a reference rotation amount stored last time, by a given amount or more, there is a possibility that abnormality occurs, for example, in the contact between the contact member and the adjusting screw. Thus, in such a situation, an error message may be indicated or displayed.

After the adjusting screw 221 is set at the reference position, the press-roll gap adjustment instruction unit 501 operates to rotationally drive the servomotor 220 with a drive current corresponding to a torque value equal to or less than the given limit torque value so as to allow the gap between the press roll 44 and the upper corrugating roll 23 to be increased from a reference gap between the two rolls 44, 23 at a time when the adjusting screw 221 is located at the reference position, by the press-roll gap adjustment value.

When rotationally driving the servomotor 220 by a rotation amount corresponding to the press-roll gap adjustment value, the press-roll gap adjustment instruction unit 501 operates to stop the rotation of the servomotor 220. In this case, the adjusting screw 221 moves the contact member 212 downwardly (in FIG. 4) from the reference position by an amount corresponding to the press-roll gap adjustment value. Thus, the swingable frame 40 is slightly rotated about a pivot shaft 41 in a counterclockwise direction, and positioned, so that the right end portion of the press roll 44 is positioned with respect to the upper corrugating roll 23, with a gap reduced from the reference position by the press-roll gap adjustment value, therebetween.

The press-roll gap adjustment instruction unit 501 also performs control of the servomotor 240 in a parallel way, in the same manner as that for the servomotor 220. Thus, a head of the adjusting screw of the leveling block 235 is set at a reference position for adjusting a gap between a left end portion (in FIG. 2) of the press roll 44 and the upper corrugating roll 23. Subsequently, the swingable frame 42 is slightly rotated about a pivot shaft 43, and positioned, so that the left end portion of the press roll 44 is positioned with respect to the upper corrugating roll 23, with a gap reduced from the reference position by the press-roll gap adjustment value, therebetween.

<<Effects of Single Facer According to Third Embodiment>>

In the third embodiment, in order to detect the rotation torque of the servomotor 220 (240) the press-roll gap adjusting motor control device 500 is provided with a circuit for feeding back a drive current supplied from the drive circuit 502 (503), to the press-roll gap adjustment instruction unit 501, wherein the fed-back drive current is utilized to detect the magnitude of the vibration occurring in the press roll 44, so that it is not necessary to provide a special vibration detection device in the vicinity of the press roll 44. Generally, such a special vibration detection device is likely to confront a problem of difficulty in accurately detecting the magnitude of the vibration of the processing roll (press or glue roll), because it is exposed to high temperatures and floating dust inside the single facer 1. In contrast, providing the circuit for feeding back a drive current to be supplied to the servomotor makes it possible to accurately detect the vibration of the processing roll.

[Correspondence Relationship Between Elements in Appended Claims and Embodiments]

The single facer 1 is one example of "single facer" set forth in the appended claims. The corrugating roll 23 (24) is one example of "corrugating roll" set forth in the appended claims, and the upper corrugating roll 23 is one example of "specific corrugating roll" set forth in the appended claims. The glue roll 30 or the press roll 44 is one example of "processing roll" set forth in the appended claims. The support plate portions 27, 28 or the swingable frames 40, 42 are one example of "supporting mechanism" set forth in the appended claims, and one example of "first and second supporting mechanisms" set forth in the appended claims. The swingable frame 40 (42) is one example of "swingable member" set forth in the appended claims. The glue-application hydraulic cylinders 32, 33 or the press hydraulic cylinders 47, 48 are one example of "pressing actuator section" set forth in the appended claims. The leveling blocks 115, 135 or the leveling blocks 215, 235 are one example of "restricting mechanism" set forth in the appended claims, and one example of "first and second restricting mechanisms" set forth in the appended claims. The wedge-shaped body 117 (217) is one example of "movable member" set forth in the appended claims, and a combination of the wedge-shaped body 118 (218) and the adjusting screw 121 (221) is one example of "restriction member" set forth in the appended claims. The externally-threaded shaft 119 (219) is one example of "threaded shaft" set forth in the appended claims. The servomotors 120, 140 or the servomotors 220, 240 are one example of "motor" set forth in the appended claims, and one example of "first and second motors" set forth in the appended claims. The glue-roll gap adjusting motor control device 352 (400) or the press-roll gap adjusting motor control device 353 (404, 500) is one example of "control section" set forth in the appended claims. The encoders EC 11, EC12 or the encoders EC 21, EC22 is one example of "detection device configured to detect a rotational change amount" set forth in the appended claims, and one example of "first and second detection devices" set forth in the appended claims. The circuits for feeding back a drive current from the drive circuits 502, 503 to the press-roll gap adjustment instruction unit 501 is one example of "detection device configured to detect a rotation torque" set forth in the appended claims, and one example of "first and second detection devices" set forth in the appended claims. The control processing to be executed by the glue-roll gap adjusting motor control device 352 (400) or the press-roll gap adjusting motor control device 353 (403), wherein the servomotors 120, 140 or the servomotors 220, 240 are driven with the first torque value in such a manner as to allow each of the heads of the adjusting screws of the leveling blocks to be set at the reference position for adjusting the gap between each of the right and left end portions of the glue or press roll 30 or 44 and the upper corrugating roll 23, is one example of "first control processing" set forth in the appended claims. The control processing to be executed by the glue-roll gap adjusting motor control device 352 (400) or the press-roll gap adjusting motor control device 353 (403), wherein the servomotors 120, 140 or the servomotors 220, 240 are driven with the second torque value in such a manner as to allow each of the right and left end portions of the glue roll 30 or each of the right and left end portions of press roll 44 to be positioned with respect to the upper corrugating roll 23, with a gap increased from the reference position by the glue-roll gap adjustment value or the press-roll gap adjustment value, therebetween, is one example of "second control processing" set forth in the appended claims. The control processing to be executed by the press-roll gap adjustment instruction unit 501 of the press-roll gap adjusting motor control device 500, wherein the servomotors 220, 240 are driven in such a manner as to allow the rotation torque of each of the servomotors 220, 240 to be restricted to the given limit torque value, thereby allowing each of the heads of the adjusting screws of the leveling blocks 215, 235 to be set at the reference position for adjusting the gap between each of the right and left end portions of the press roll 44 and the upper corrugating roll 23, is one example of "first control processing" set forth in the appended claims. The control processing to be executed by the press-roll gap adjustment instruction unit 501, wherein the servomotors 220, 240 are driven in such a manner as to allow each of the right and left end portions of press roll 44 to be positioned with respect to the upper corrugating roll 23, with a gap reduced from the reference position by the press-roll gap adjustment value, therebetween, is one example of "second control processing" set forth in the appended claims.

[Modification]

While the present invention has been described based on the embodiments thereof, it is obvious to those skilled in the art that various changes and modifications may be made therein without departing from the spirit and scope thereof as set forth in appended claims.

(1) In all of the above embodiments, the glue roll 30 or the press roll 44 is used as one example of a processing roll configured to be pressed against the upper corrugating roll 23 through the corrugated medium 10 or through the corrugated medium 10 and the liner 11. However, the present invention is not limited to such processing rolls. For example, the processing roll may be any other type as long as it is configured to be pressed against either one of two corrugating rolls, and has a need for adjusting a gap with respect to the corrugating roll.

(2) In the third embodiment, the press roll 44 is made of a non-metal material such as an aramid fiber material, which has elasticity greater than that of chromium molybdenum steel as a material for the corrugating roll. However, the press roll 44 may be made of any non-metal material other than an aramid fiber material. For example, the press roll may be made of silicone rubber. When silicone rubber is used as a material for the press roll, silicone rubber has elasticity greater than that of an aramid fiber material. Specifically, a compressive strength (Young's modulus) of silicone rubber has a small value of about 1/300 of a compressive strength (Young's modulus) of an aramid fiber material. When the press roll is pressed against the upper corrugating roll through a corrugated medium and a linerboard, the corrugated medium and the linerboard are compressed, and the press roll is also compressed. The press roll can be made of an elastically deformable non-metal material such as silicone rubber so as to suppress the formation of a press mark during production of a single-faced corrugated paperboard. In the case where the press roll is made of an elastically deformable non-metal material, it is necessary to more accurately set the gap between the press roll and upper corrugating roll. In this case, the gap between the press roll and upper corrugating roll can be accurately set by positioning the adjusting screw equivalent to "restriction member" set forth in the appended claims, at the reference position. In the case where the press roll is made of an elastically deformable non-metal material such as silicone rubber, the control processing for changing the gap between the press roll and upper corrugating roll according to the press-roll gap adjustment value, after the head of the adjusting screw of each of the leveling blocks is positioned at the reference position is not executed. That is, when the head of the adjusting screw of each of the leveling blocks is positioned at the reference position, the head of the adjusting screw is held at the reference position.

(3) In the third embodiment, the glue roll 30 is made of a metal material such as carbon steel, and the press roll 44 is made of a non-metal material such as an aramid fiber material, which has elasticity greater than that of chromium molybdenum steel as a material for the corrugating roll. However, the present invention is not limited to such a combination. For example, the glue roll 30 may be made of a non-metal material such as an aramid fiber material, which has elasticity greater than that of chromium molybdenum steel as a material for the corrugating roll, and the press roll 44 may be made of a metal material such as carbon steel. Alternatively, both of the glue roll 30 and the press roll 44 may be made of a non-metal material such as an aramid fiber material, which has elasticity greater than that of chromium molybdenum steel as a material for the corrugating roll. In the modification where the glue roll 30 is made of a non-metal material such as an aramid fiber material, the glue-roll gap adjustment value for the glue roll 30 is stored in the glue-roll gap adjustment table 320A of the program memory 320. In the modification where the press roll 44 is made of a non-metal material such as an aramid fiber material, the glue-roll gap adjustment value and the press-roll gap adjustment value are set through experiment, depending on goodness of laminating conditions for the corrugated medium 10 and the linerboard 11 of the single-faced corrugated paperboard 12. The goodness of laminating conditions has a meaning including an amount of glue to be applied to the corrugated medium.

(4) In the second embodiment, the gap adjustment control is configured such that the time period from the time point TS0 to the time point TS3 and the rotational speed of the servomotor 220 are detected by the encoder EC21, and it is determined whether or not the control time period CT has elapsed from the time point TS3 when the servomotor 220 is first stopped, as illustrated in FIG. 10. However, the present invention is not limited to this configuration. For example, the gap adjustment control may be configured such that the time period from the time point TS0 to the time point TSN is preliminarily and experimentally measured with respect to each type of paperboard for each of a corrugated medium and a linerboard, such as each thickness of a paperboard, and stored in a storage section, whereafter one time period corresponding to a type of paperboard for each of a corrugated medium and a linerboard for implementing an order is read from the storage section and the servomotor is continually driven during the read time period. Alternatively, the gap adjustment control may be configured such that the rotation amount by which the servomotor is rotated in the time period from the time point TS0 to the time point TSN is preliminarily and experimentally measured, and stored in a storage section, whereafter one rotation amount corresponding to a type of paperboard for each of a corrugated medium and a linerboard for implementing an order is read from the storage section, and the servomotor is continually driven by the read rotation amount.

(5) In all of the above embodiments, the gap adjustment apparatus 100 (200) is configured to allow the adjusting screw 121 (221) provided in the leveling block to come into contact with the contact member 112 (212) coupled to a member supporting the glue roll 30 (press roll 44). However, the present invention is not limited to this configuration. For example, the gap adjustment apparatus may be configured such that an adjusting screw is provided in a member capable of being linearly moved according to a contact with an eccentric cam being rotationally driven by a servomotor, wherein the adjusting screw is configured to come into contact with the contact member. Alternatively, as disclosed, for example, in the JP 58-042025 B, the gap adjustment apparatus may be configured to comprise a leveling block having a pair of wedges whose relative positions can be changed by a motor, wherein an eccentric member supporting a processing roll is moved by a movement of the leveling block.

(6) In the first embodiment, the gap adjustment apparatus is configured such that the magnitude of the vibration occurring in the glue roll 30 or the press roll 44 is detected by the encoder EC11 (EC12) or the encoder EC 21 (EC 22) in the form of a rotational speed change amount in the servomotor 120 (140) or the servomotor 220 (240), as illustrated in FIG. 8. However, the present invention is not limited to this configuration. For example, the gap adjustment apparatus may be configured such that a vibration detection device is disposed in adjacent relation to a processing roll or a member supporting the processing roll, wherein the servomotor is driven until a magnitude of vibration detected by the vibration detection device is reduced to a given value, and a gap between the processing roll and the upper corrugating roll is adjusted on the basis of a reference position defined as a position of the adjusting screw at a time when the magnitude of the vibration becomes the given value. In this modification, until the magnitude of the vibration is reduced to the given value, the servomotor may be driven by a drive current corresponding to either one of the first torque value and the second torque value.

(7) In all of the above embodiments, the lower-level management device 310 is configured such that the interval of generation of the timing instruction is extended as the internal temperature of the single facer 1 is increased toward the reference temperature TRF, as illustrated in FIG. 7. However, the present invention is not limited to this configuration. For example, the lower-level management device may be configured to generate the timing instruction at even intervals during a time period in which the internal temperature of the single facer 1 is increased toward the reference temperature TRF, and stop generating the timing instruction as long as the internal temperature of the single facer 1 falls within a given temperature fluctuation range on the basis of the reference temperature TRF.

(8) In the first and second embodiments, the press-roll gap adjustment value is a value obtained by subtracting a total thickness of the corrugated medium 10 and the linerboard 11 at a time when the corrugated medium 10 and the linerboard 11 are compressed by a compression force corresponding to a pressing force applied from the contact member 212 to the adjusting screw 221 when the adjusting screw 221 is located at the reference position, from a total thickness of the corrugated medium 10 and the linerboard 11 in an uncompressed state, and set experimentally. However, the press-roll gap adjustment value may be set in a different manner. For example, the press-roll gap adjustment value may be a value obtained by subtracting a total thickness of the corrugated medium 10 and the linerboard 11 at a time when the corrugated medium 10 and the linerboard 11 are compressed by a compression force corresponding to a pressing force applied from the contact member 212 to the adjusting screw 221 when the adjusting screw 221 is located at the reference position, from a total thickness of the corrugated medium 10 and the linerboard 11 at a time when the corrugated medium 10 and the linerboard 11 are uncompressed by a compression force corresponding to a pressing force sufficiently smaller than that at the reference position, and set experimentally. The glue-roll gap adjustment value may be set in the same manner as that for the press-roll gap adjustment value.

(9) In the first embodiment, the gap adjustment apparatus is configured such that the magnitude of the vibration occurring in the glue roll 30 or the press roll 44 is detected by the encoder EC11 (EC12) or the encoder EC 21 (EC 22) in the form of a rotational speed change amount in the servomotor 120 (140) or the servomotor 220 (240). In the third embodiment, the gap adjustment apparatus is configured such that the magnitude of the vibration occurring in the glue roll 30 or the press roll 44 is detected by the circuit for feeding back a drive current supplied from the drive circuit 502 (503), to the press-roll gap adjustment instruction unit 501, in the form of the rotation torque of the servomotor 120 (140) or the servomotor 220 (240). However, the detection device for detecting the magnitude of the vibration occurring in the glue roll 30 or the press roll 40 is not limited to the configurations in the first to third embodiments. For example, the detection device may be configured to detect a pressure acting between the movable portion of the supporting mechanism and the restriction member, as vibration occurring in a processing roll, by a load sensor such as a load cell, and the control section may be configured to drive the servomotor until a state in which a pressure detected by the detection device is increased to a given pressure continues for a given time. In this modification, the given pressure and the given time is predetermined by an experiment. In this case, the pressure acting between the movable portion of the supporting mechanism and the restriction member is detected as vibration occurring in a processing roll, so that it is not necessary to install a gap detection sensor in adjacent relation to the corrugating roll as in conventional single facers.

What is claimed is:

1. A single facer for producing a single-faced corrugated paperboard by forming a corrugated medium and gluing a linerboard onto the corrugated medium, comprising:

a pair of corrugating rolls configured to be rotatable to form the corrugated medium;

a press roll configured to be rotatable around a rotation center of the press roll;

a swingable frame configured to support the press roll for swing motion around a swing center away from the rotation center;

a press cylinder configured to press the press roll to swing in a direction for pressing the corrugated medium against one of the pair of corrugating rolls, wherein the swingable frame vibrates, along with the press roll, around the swing center as the corrugated medium passes between the press roll and the one of the pair of corrugating rolls;

a restricting mechanism comprising a adjusting screw configured to be movable towards or away from the swingable frame, the restricting mechanism being operable to move the adjusting screw to come in contact with the swingable frame to restrict oscillation vibration of the swingable frame and the press roll that occurs as the corrugated medium passes between the press roll and the one of the pair of corrugating rolls;

a motor drive circuit configured to drive a motor to apply a motor torque to the adjusting screw to urge the adjusting screw against the swingable frame and detect vibration of the motor torque of the motor based on a motor current flowing through the motor; and a press roll gap adjustment instruction circuit programmed to execute a first control processing which comprises driving the motor to perform constant motor torque control on the motor torque so that the adjusting screw is pressed against the swingable frame while being in contact with the swingable frame, wherein the adjusting screw makes an advance to push the swingable frame at every cycle of the vibration of the swingable frame so that a magnitude of the vibration of the swingable frame progressively decreases at every cycle of the vibration, and the press roll gap adjustment instruction circuit further programmed to monitor the vibration detected by the motor drive circuit and operate the motor to cease application of the motor torque on the adjusting screw when the detected vibration becomes smaller than a predetermined magnitude.

2. The single facer according to claim 1, wherein the press roll gap adjustment instruction circuit is further programmed to execute a second control processing which comprises:

defining a position of the adjusting screw as a reference position of the adjusting screw when the detected vibration becomes smaller than the predetermined magnitude; and driving the motor to move the swingable frame until a gap between the press roll and the one of the pair of corrugating rolls becomes equal to a given adjustment value.

3. The single facer according to claim 2, wherein the press roll is made of a non-metal material, and the given adjustment value is determined based on a combination of respective properties of the corrugated medium and the linerboard or based on a property of the corrugated medium.

4. The single facer according to claim 1, wherein the press roll is a press roll made of a non-metal material having elasticity greater than that of the one of the pair of corrugating roll.

5. The single facer according to claim 1, wherein the restricting mechanism further comprises:

an externally-threaded shaft configured to be rotated by the motor;

a first movable member formed to have a first inclined surface, the first movable member being threadingly engaged with the externally-threaded shaft, wherein rotation of the externally-threaded shaft moves the first movable member in a length direction of the externally-threaded shaft; and a second movable member formed to have a second inclined surface being in sliding contact with the first inclined surface of the first movable member, wherein the sliding contact between the first and second inclined surfaces of the first and second movable members is operable to translate rotation of the externally-threaded shaft into movement of the adjusting screw in a direction perpendicular to the length direction of the externally-threaded shaft.

6. The single facer according to claim 1, wherein the adjusting screw is situated such that a distance between the adjusting screw and the swing center is longer than a distance between the swing center and the rotation center of the press roll.

7. A single facer for producing a single-faced corrugated paperboard by forming a corrugated medium and gluing a linerboard onto the corrugated medium, comprising:

a pair of corrugating rolls configured to be rotatable to form the corrugated medium;

a press roll configured to be rotatable around a rotation center of the press roll;

first and second swingable frames configured to support opposite ends of a rotary shaft of the press roll so that the press roll swings around a swing center away from the rotation center;

a press cylinder configured to press the press roll to swing in a direction for pressing the corrugated medium against one of the pair of corrugating rolls, wherein the first and second swingable frames vibrate, along with the press roll, around the swing center as the corrugated medium passes between the press roll and the one of the pair of corrugating rolls;

first and second restricting mechanisms provided, respectively, for the first and second swingable frames, each of the first and second restricting mechanisms comprising a adjusting screw configured to be movable towards or away from a corresponding one of the first and second swingable frames, the first and second restricting mechanisms being operable to move their adjusting screws to come in contact, respectively, with the first and second swingable frames to restrict vibration of the first and second swingable frames and the press roll that occurs as the corrugated medium passes between the press roll and the one of the pair of corrugating rollers;

first and second motors driven to apply a torque to the first and second adjusting screws to urge the first and second swingable frames, respectively, against the first and second swingable frames;

first and second motor drive circuits provided, respectively, for the first and second restricting mechanisms and configured to drive first and second motors, respectively, to apply a motor torque to the first and second adjusting screws to urge the first and second adjusting screws, respectively, against the first and second swingable frames and detect vibration of the motor torque of the first and second motors based on motor current flowing through the first and second motors; and a press roll gap adjustment instruction circuit programmed to execute a first control processing which comprises driving the first and second motors to perform constant motor torque control on the motor torque so that the first and second adjusting screws are pressed, respectively, against the first and second swingable frames while being in contact, respectively, with the first and second swingable frames, wherein the first and second adjusting screws make an advance to push the first and second swingable frames, respectively, at every cycle of the vibration of the first and second swingable frames so that a magnitude of the vibration of the first and second swingable frames progressively decreases at every cycle of the vibration, and the press roll gap adjustment instruction circuit further programmed to monitor the vibration detected by the first and second motor drive circuits and operate the first and second motors to cease application of the motor torque on the first and second adjusting screws when the detected vibration becomes smaller than a predetermined magnitude.

* * * * *